US011472205B2

(12) United States Patent
Fujiwara

(10) Patent No.: US 11,472,205 B2
(45) Date of Patent: Oct. 18, 2022

(54) CONVEYING DEVICE, LIQUID DISCHARGE APPARATUS, IMAGE FORMING APPARATUS, AND POST-PROCESSING APPARATUS

(71) Applicant: Yasuhiro Fujiwara, Kanagawa (JP)

(72) Inventor: Yasuhiro Fujiwara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/129,917

(22) Filed: Dec. 22, 2020

(65) Prior Publication Data

US 2021/0197583 A1 Jul. 1, 2021

(30) Foreign Application Priority Data

Dec. 26, 2019 (JP) ..... JP2019-236164

(51) Int. Cl.

| | |
|---|---|
| ***B41J 2/01*** | (2006.01) |
| ***B41J 11/00*** | (2006.01) |
| ***B65H 37/04*** | (2006.01) |
| ***B65H 5/06*** | (2006.01) |

(52) U.S. Cl.

CPC ..... *B41J 11/007* (2013.01); *B41J 11/0015* (2013.01); *B65H 5/062* (2013.01); *B65H 37/04* (2013.01)

(58) Field of Classification Search

None

See application file for complete search history.

(56) References Cited

U.S. PATENT DOCUMENTS

| | | | | |
|---|---|---|---|---|
| 2015/0008636 | A1* | 1/2015 | Tsuda | B41J 11/0005 271/3.2 |
| 2018/0272756 | A1* | 9/2018 | Kodama | B41J 3/60 |
| 2018/0272764 | A1* | 9/2018 | Tamura | B41J 13/26 |
| 2019/0263147 | A1* | 8/2019 | Nagahara | B41J 29/13 |

FOREIGN PATENT DOCUMENTS

| | | | | |
|---|---|---|---|---|
| CN | 107175933 A | * | 9/2017 | B65H 5/062 |
| JP | 2002-220147 | | 8/2002 | |

* cited by examiner

*Primary Examiner* — Erica S Lin
*Assistant Examiner* — Tracey M McMillion
(74) *Attorney, Agent, or Firm* — Xsensus LLP

(57) ABSTRACT

A conveying device includes a plurality of rotating bodies and a plurality of projecting rotators. The rotating bodies are spaced apart in a sheet conveyance direction in which a sheet is conveyed. The projecting rotators are spaced apart in the sheet conveyance direction on a side of an opposite face opposite a liquid applied face of the sheet. Each of the projecting rotator has a plurality of projections projecting radially outward. The rotating bodies are arranged to contact the projecting rotators. A contact pressure of the rotating bodies with the projecting rotators is smaller on an upstream side than on a downstream side in the sheet conveyance direction. One of an interval between the rotating bodies in the sheet conveyance direction and an interval between the projecting rotators in the sheet conveyance direction is smaller on the upstream side than on the downstream side in the sheet conveyance direction.

21 Claims, 16 Drawing Sheets

CONVEYING DEVICE, LIQUID DISCHARGE APPARATUS, IMAGE FORMING APPARATUS, AND POST-PROCESSING APPARATUS

CROSS-REFERENCE TO RELATED APPLICATION

This patent application is based on and claims priority pursuant to 35 U.S.C. § 119(a) to Japanese Patent Application No. 2019-236164, filed on Dec. 26, 2019, in the Japan Patent Office, the entire disclosure of which is hereby incorporated by reference herein.

BACKGROUND

Technical Field

Embodiments of the present disclosure relate to a conveying device, a liquid discharge apparatus, an image forming apparatus, and a post-processing apparatus.

Related Art

For example, an image forming apparatus such as a copying machine or a printer includes a conveying device that conveys a sheet to which liquid such as ink adheres.

For example, a configuration is proposed in which a recording sheet to which ink has adhered is conveyed while being nipped between a roller and a spur.

SUMMARY

According to an aspect of the present disclosure, there is provided a conveying device that includes a plurality of rotating bodies and a plurality of projecting rotators. The plurality of rotating bodies are spaced apart in a sheet conveyance direction in which a sheet is conveyed. The plurality of projecting rotators are spaced apart in the sheet conveyance direction on a side of an opposite face opposite a liquid applied face of the sheet. Each of the plurality of projecting rotators has a plurality of projections projecting radially outward. The plurality of rotating bodies are arranged to contact the plurality of projecting rotators. A contact pressure of the plurality of rotating bodies with the plurality of projecting rotators is smaller on an upstream side in the sheet conveyance direction than on a downstream side in the sheet conveyance direction. One of an interval between the plurality of rotating bodies in the sheet conveyance direction and an interval between the plurality of projecting rotators in the sheet conveyance direction is smaller on the upstream side in the sheet conveyance direction than on the downstream side in the sheet conveyance direction.

According to another aspect of the present disclosure, there is provided a conveying device that includes a plurality of rotating bodies and a plurality of projecting rotators. The plurality of rotating bodies are spaced apart in a sheet conveyance direction in which a sheet is conveyed. The plurality of projecting rotators are spaced apart in the sheet conveyance direction on a side of an opposite face opposite a liquid applied face of the sheet. Each of the plurality of projecting rotators has a plurality of projections projecting radially outward. The plurality of rotating bodies are arranged to contact the plurality of projecting rotators. A contact pressure of the plurality of rotating bodies with the plurality of projecting rotators is smaller on an upstream side in the sheet conveyance direction than on a downstream side in the sheet conveyance direction. A number of the plurality of projecting rotators arranged in a sheet width direction is larger on the upstream side in the sheet conveyance direction than on the downstream side in the sheet conveyance direction.

According to still another aspect of the present disclosure, there is provided a conveying device that includes a plurality of rotating bodies and a plurality of projecting rotators. The plurality of rotating bodies are spaced apart in a sheet conveyance direction in which a sheet is conveyed. The plurality of projecting rotators are spaced apart in the sheet conveyance direction on a side of an opposite face opposite a liquid applied face of the sheet, each of the plurality of projecting rotators having a plurality of projections projecting radially outward. The plurality of rotating bodies are shifted from the plurality of projecting rotators in an axial direction so that the plurality of rotating bodies does not contact the plurality of projecting rotators. An entry amount of the plurality of projecting rotators that enters in an inner diameter direction of the plurality of rotating bodies beyond an outer peripheral surface of the plurality of rotating bodies is smaller on an upstream side in the sheet conveyance direction than on a downstream side in the sheet conveyance direction. One of an interval between the plurality of rotating bodies in the sheet conveyance direction and an interval between the plurality of projecting rotators in the sheet conveyance direction is smaller on the upstream side in the sheet conveyance direction than on the downstream side in the sheet conveyance direction.

According to still yet another aspect of the present disclosure, there is provided a conveying device that includes a plurality of rotating bodies and a plurality of projecting rotators. The plurality of rotating bodies are spaced apart in a sheet conveyance direction in which a sheet is conveyed. The plurality of projecting rotators are spaced apart in the sheet conveyance direction on a side of an opposite face opposite a liquid applied face of the sheet, each of the plurality of projecting rotators having a plurality of projections projecting radially outward. The plurality of rotating bodies are shifted from the plurality of projecting rotators in an axial direction so that the plurality of rotating bodies does not contact the plurality of projecting rotators. An entry amount of the plurality of projecting rotators that enters in an inner diameter direction of the plurality of rotating bodies beyond an outer peripheral surface of the plurality of rotating bodies is smaller on an upstream side in the sheet conveyance direction than on a downstream side in the sheet conveyance direction. A number of the plurality of projecting rotators arranged in a sheet width direction is larger on the upstream side in the sheet conveyance direction than on the downstream side in the sheet conveyance direction.

According to still yet another aspect of the present disclosure, there is provided a liquid discharge apparatus that includes the conveying device according to any one of the above-described aspects and a liquid discharger configured to discharge liquid onto the sheet.

According to still yet another aspect of the present disclosure, there is provided an image forming apparatus that includes the conveying device according to any one of the above-described aspects and an image forming device configured to discharge liquid onto the sheet to form an image onto the sheet.

According to still yet another aspect of the present disclosure, there is provided a post-processing apparatus that includes the conveying device according to any one of the above-described aspects and a post-processing device configured to perform processing on the sheet.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
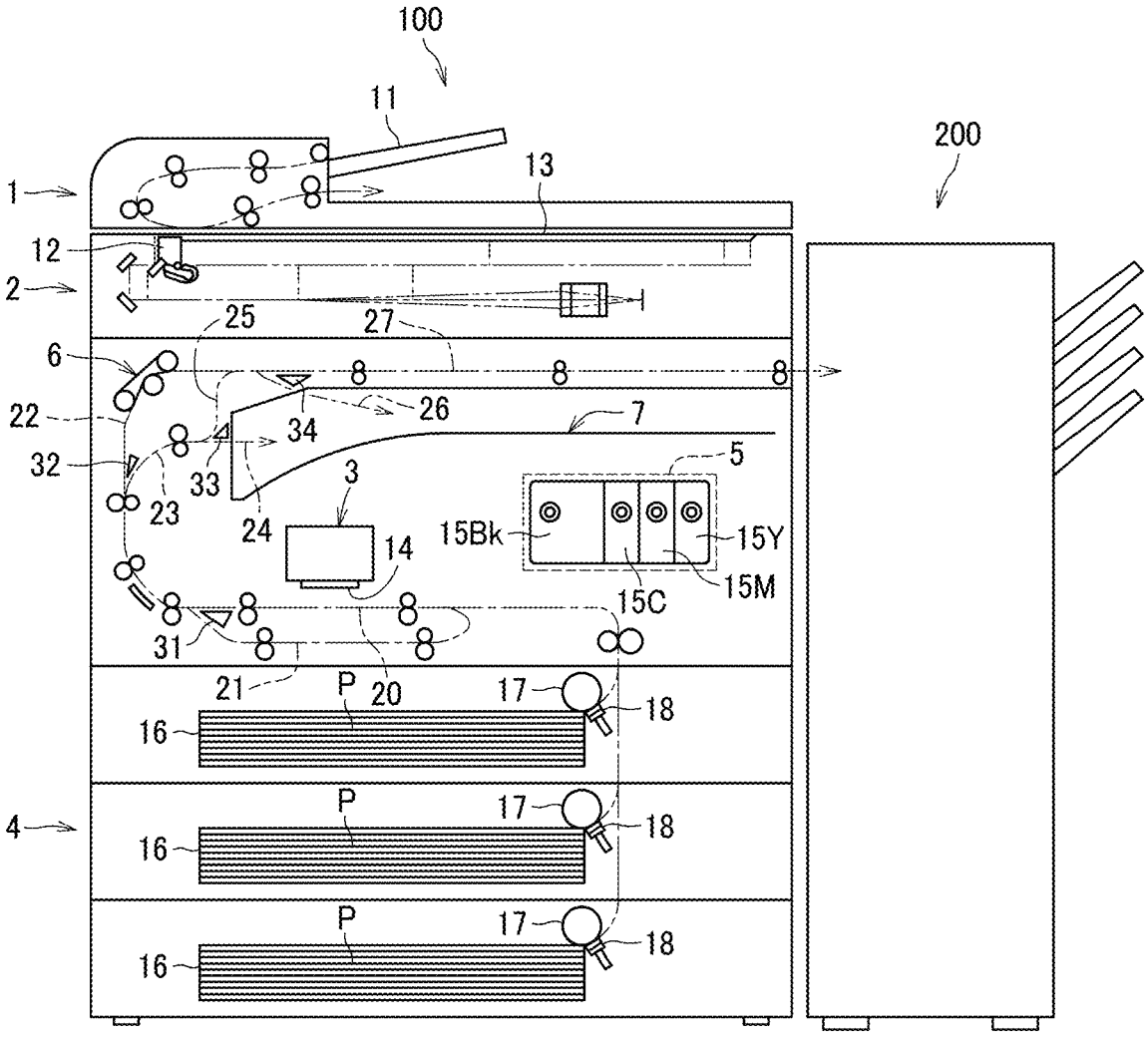
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to drawings, descriptions are given below of embodiments of the present disclosure. It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming apparatus according to an embodiment of the present disclosure.

As illustrated in FIG. 1, an image forming apparatus 100 according to the present embodiment includes an original document conveying device 1, an image reading device 2, an image forming device 3, a sheet feeding device 4, a cartridge container 5, a drying device (heating device) 6, and a sheet ejection portion 7. Further, a sheet alignment apparatus 200 is disposed adjacent to the image forming apparatus 100.

The original document conveying device 1 separates an original document from the other original documents one by one from a set of original documents on an original document tray 11 and conveys the separated original document toward an exposure glass 13 of the image reading device 2. The original document conveying device 1 includes a plurality of conveyance rollers each functioning as an original document conveyor to convey the original document.

The image reading device 2 is an image scanner, in other words, a device to scan the image on an original document placed on the exposure glass 13 or the image on an original document as the original document passes over the exposure glass 13. The image reading device 2 includes an optical scanning unit 12 as an image reading unit. The optical scanning unit 12 includes a light source that irradiates an original document placed on the exposure glass 13 with light, and a charge-coupled device (CCD) as an image reader that reads an image from the reflected light of the original document. Further, a close contact-type image sensor (CIS) may be employed as an image reader.

The image forming device 3 includes a liquid discharge head 14 that functions as a liquid discharger to discharge ink that is liquid used for image formation. The liquid discharge head 14 may be a serial-type liquid discharge head that discharges ink while moving in the main scanning direction of a sheet (i.e., the sheet width direction) or a line-type liquid discharge head that discharges ink without moving a plurality of liquid discharge heads aligned in the main scanning direction.

Ink cartridges 15Y, 15M, 15C, and 15K are detachably attached to the cartridge container 5. The ink cartridges 15Y, 15M, 15C, and 15K are filled with inks of different colors such as yellow, magenta, cyan, and black, respectively. The ink in each ink cartridge (i.e., the ink cartridges 15Y, 15M, 15C, 15K) is supplied to the liquid discharge head 14 by an ink supply pump.

The sheet feeding device 4 includes a plurality of sheet feed trays 16 each functioning as a sheet container. Each sheet feed tray 16 loads a bundle of sheets including a sheet P. Each sheet P on which an image is formed is a cut sheet cut in a predetermined size, e.g., A4 size and B4 size, and is previously contained in the sheet feed tray 16 in a corresponding sheet conveyance direction. Further, each sheet feed tray 16 includes a sheet feed roller 17 that functions as a sheet feeder and a sheet separation pad 18 that functions as a sheet separator.

The drying device 6 includes a pair of heating rotating bodies that heat a sheet while conveying the sheet with the sheet interposed between the heating rotating bodies. A heating source included in the drying device 6 may be a radiant-heat-type heater that emits infrared rays such as a halogen heater or a carbon heater, or an electromagnetic-induction-type heating source. Alternatively, the drying device 6 may be a hot air generator that blows hot air onto the sheet to heat the sheet.

The sheet alignment apparatus 200 functions as a post-processing apparatus to align and register the sheets P conveyed from the image forming apparatus 100. Further, in addition to the sheet alignment apparatus 200, another post-processing apparatus such as a stapling device that staples (binds) the sheets and a punching device that punches holes in the sheet may be installed.

With continued reference to FIG. 1, a description is given of an operation of the image forming apparatus according to the present embodiment.

As an instruction is given to start the printing operation, a sheet P is fed from one sheet feed tray 16 of the plurality of sheet feed trays 16. To be more specific, as the sheet feed roller 17 rotates, an uppermost sheet P placed on top of the bundle of sheets P contained in the sheet feed tray 16 is fed by the sheet feed roller 17 and the sheet separation pad 18 while the uppermost sheet P is separated from the other sheets of the bundle of sheets.

When the sheet P is conveyed to a sheet conveyance passage 20 that extends in the horizontal direction and faces the image forming device 3, the image forming device 3 forms an image on the sheet P. To be more specific, the liquid discharge head 14 is controlled to discharge liquid (ink) according to image data of the original document read by the image reading device 2 or print data instructed to print by an external device, so that ink is discharged on an image forming face (upper face) of the sheet P to form an image. Note that the image to be formed on the sheet P may be a meaningful image such as text or a figure, or a pattern having no meaning per se.

When duplex printing is performed, the sheet P is conveyed in the opposite direction opposite the sheet conveyance direction at a position downstream from the image forming device 3 in the sheet conveyance direction, so that the sheet P is guided to a sheet reverse passage 21. To be more specific, after the trailing end of the sheet P has passed a first passage changer 31 that is disposed downstream from the image forming device 3 in the sheet conveyance direction, the sheet P is conveyed in the opposite direction. Further, after the trailing end of the sheet P has passed the first passage changer 31, the first passage changer 31 changes the sheet conveyance passage of the sheet P to the sheet reverse passage 21. Accordingly, the sheet P is guided to the sheet reverse passage 21. Then, as the sheet P passes through the sheet reverse passage 21, the sheet P is reversed upside down and conveyed to the image forming device 3 again. Then, the image forming device 3 repeats the same operation performed to the front face of the sheet P, so as to form an image on the back face of the sheet P.

A second passage changer 32 is disposed downstream from the first passage changer 31 in the sheet conveyance direction. The second passage changer 32 guides the sheet P with the image selectively to a sheet conveyance passage 22 that runs through the drying device 6 or to a sheet conveyance passage 23 that does not run through the drying device 6. When the sheet P is guided to the sheet conveyance passage 22 through which the sheet P passes the drying device 6, the drying device 6 dries the ink on the sheet P. On the other hand, when the sheet P is guided to the sheet conveyance passage 23 through which the sheet P does not pass the drying device 6, a third passage changer 33 guides the sheet P selectively to a sheet conveyance passage 24 toward the sheet ejection portion 7 or to a sheet conveyance passage 25 toward the sheet alignment apparatus 200. Further, after the sheet P has passed the drying device 6, a fourth passage changer 34 guides the sheet P selectively to a sheet conveyance passage 26 toward the sheet ejection portion 7 or to a sheet conveyance passage 27 toward the sheet alignment apparatus 200.

In a case in which the sheet P is guided to the sheet conveyance passage 24 or the sheet conveyance passage 26 toward the sheet ejection portion 7, the sheet P is ejected to the sheet ejection portion 7 with a liquid applied face of the sheet P down. On the other hand, in a case in which the sheet P is guided to the sheet conveyance passage 25 or the sheet conveyance passage 27 toward the sheet alignment apparatus 200, the sheet P is conveyed to the sheet alignment apparatus 200, so that the bundle of sheets P is aligned and stacked. Accordingly, a series of printing operations is completed.

Figure 2:
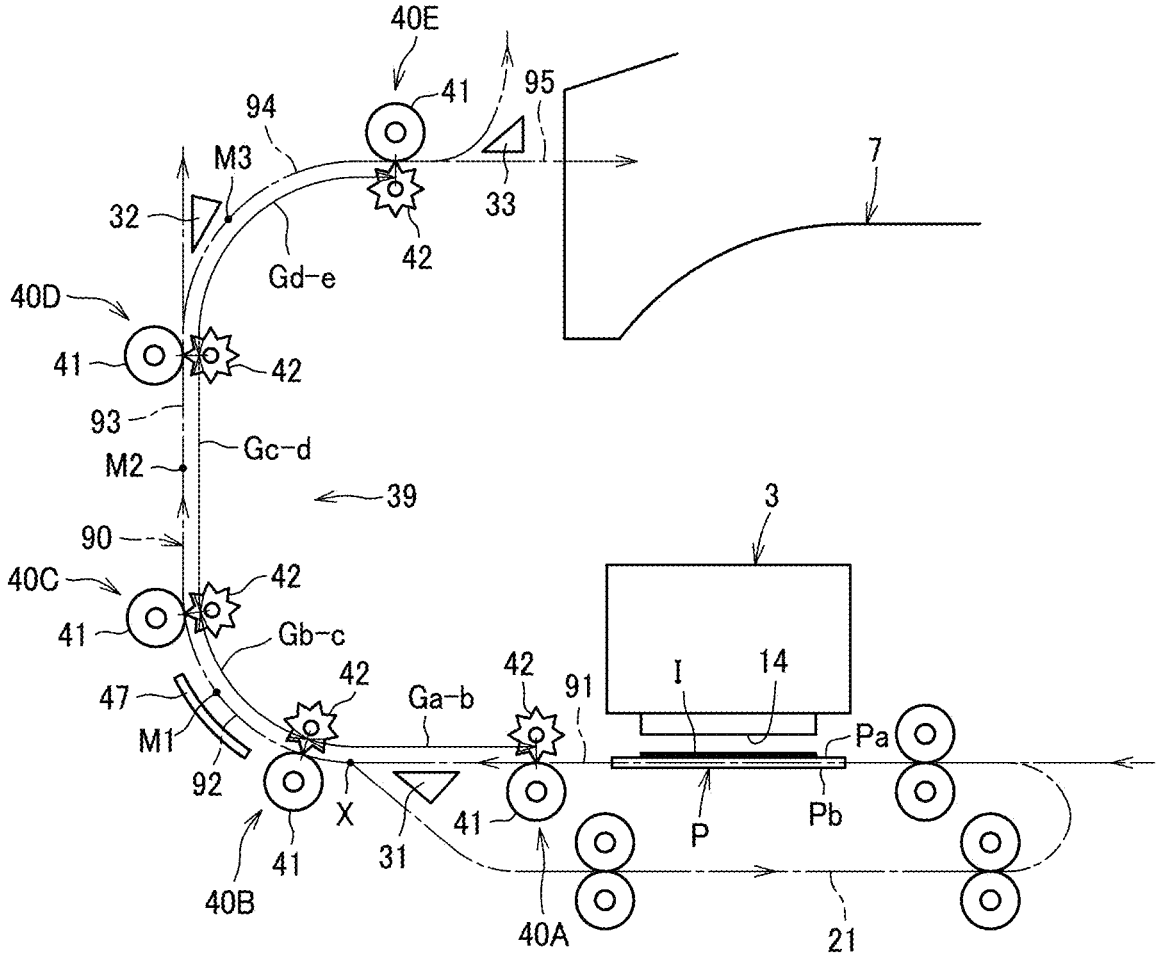
FIG. 2 is a diagram illustrating a configuration of a conveyance passage from an image forming device to a sheet ejection portion.

FIG. 2 is a diagram illustrating a configuration of a conveyance passage 90 from the image forming device 3 to the sheet ejection portion 7 illustrated in FIG. 1. In FIG. 2, the direction of each arrow on an alternate long and short dash line indicates the sheet conveyance direction in which the sheet is conveyed.

As illustrated in FIG. 2, the conveying device 39 including a plurality of rollers 41 and a plurality of spur wheels 42 is provided in a conveyance passage 90 extending from the image forming device 3 to the sheet ejection portion 7. Each of the rollers 41 and each of the spur wheels 42 are pressed against and in contact with each other by biasing members such as springs. In the present embodiment, the spur wheel 42 is biased so as to approach the roller 41. On the contrary, the roller 41 may be as to approach the spur wheel 42.

Figure 3:
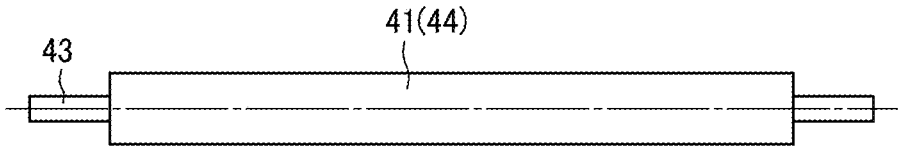
FIG. 3 is a diagram illustrating a configuration of a roller.
Figure 4:
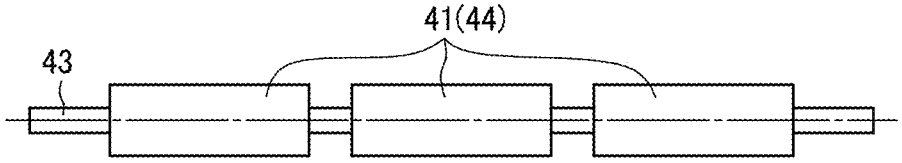
FIG. 4 is a diagram illustrating another configuration of rollers.

As illustrated in FIG. 3, the roller 41 is a cylindrical rotating body provided on the outer peripheral surface of the support shaft 43. The roller 41 is formed of an elastic body 44 such as rubber. The elastic body 44 is preferably made of a material having good separability from ink or a water repellent material. Alternatively, a coating layer made of a material having good separability from ink or a water repellent material may be provided on the outer peripheral surface of the elastic body 44. In the example illustrated in FIG. 3, the roller 41 is provided continuously in the axial direction of the support shaft 43. Alternatively, as illustrated in the example of FIG. 4, the rollers 41 may be provided intermittently in the axial direction of the support shaft 43.

Figure 5:
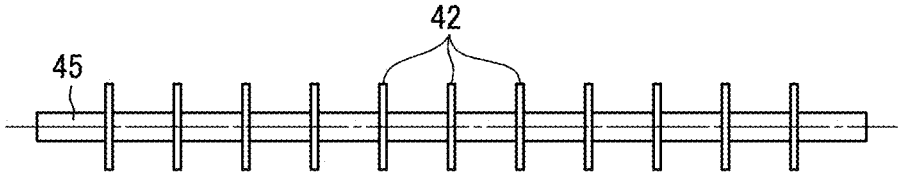
FIG. 5 is a diagram illustrating a configuration of spur wheels.
Figure 6:
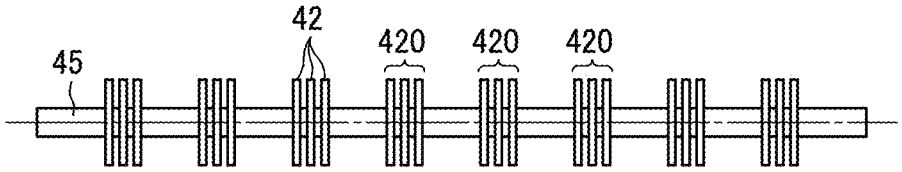
FIG. 6 is a diagram illustrating another configuration of spur wheels.

Each spur wheel 42 serving as a projecting rotator having a plurality of projections projecting radially outward. As illustrated in FIG. 5, the plurality of spur wheels 42 are disposed on the outer peripheral surface of the support shaft 45 at intervals in the axial direction of the support shaft 45. The plurality of spur wheels 42 may be disposed at equal intervals over the axial direction of the support shaft 45, as illustrated in FIG. 5, or may be disposed at different intervals. As illustrated in FIG. 6, spur wheel groups 420, in each of which the plurality of spur wheels 42 are closely disposed to each other, may be disposed at equal intervals or different intervals over the axial direction of the support shaft 45. Alternatively, the support shaft 45 may be a shaft that penetrates all the spur wheels 42, or may be provided for each spur wheel 42 or for each group of a plurality of spur wheels.

Here, assuming that a conveyance unit including the roller 41 and the spur wheel 42 disposed in contact with each other is one conveyance unit, as illustrated in FIG. 2, five conveyance units 40A to 40E are disposed at intervals in the sheet conveyance direction in the conveyance passage 90 from the image forming device 3 to the sheet ejection portion 7.

The conveyance passage 90 includes a first horizontal conveyance portion 91 facing the image forming device 3, a vertical conveyance portion 93 disposed downstream from the first horizontal conveyance portion 91 in the sheet conveyance direction, a second horizontal conveyance portion 95 disposed downstream from the vertical conveyance portion 93 in the sheet conveyance direction, a first curved conveyance portion 92 connecting the first horizontal conveyance portion 91 and the vertical conveyance portion 93, and a second curved conveyance portion 94 connecting the vertical conveyance portion 93 and the second horizontal conveyance portion 95. A guide member 47 is provided at a position corresponding to the first curved conveyance portion 92 in order to restrain jumping of the trailing edge of a sheet.

Hereinafter, the five conveyance units 40A to 40E are referred to as a first conveyance unit 40A, a second conveyance unit 40B, a third conveyance unit 40C, a fourth conveyance unit 40D, and a fifth conveyance unit 40E in order from the side closer to the image forming device 3. The arrangement of the conveyance units 40A to 40E are described below. In the following description, the upstream side in the sheet conveyance direction is simply referred to as "upstream side", and the downstream side in the sheet conveyance direction is simply referred to as "downstream side".

As illustrated in FIG. 2, the first conveyance unit 40A is disposed in the first horizontal conveyance portion 91. To be more specific, the first conveyance unit 40A is disposed on the downstream side from the image forming device 3 and on the upstream side from a branching point X at which the sheet reverse passage 21 branches from the first horizontal conveyance portion 91.

The second conveyance unit 40B is disposed on the downstream side from the first conveyance unit 40A and the upstream side from the third conveyance unit 40C. To be more specific, the second conveyance unit 40B is disposed on the downstream side from the branch point X of the sheet reverse passage 21 and on the upstream side from an intermediate position M1 of the first curved conveyance portion 92 in the sheet conveyance direction.

The third conveyance unit 40C is disposed on the downstream side from the second conveyance unit 40B and on the upstream side from the fourth conveyance unit 40D. To be more specific, the third conveyance unit 40C is disposed on the downstream side from the intermediate position M1 of the first curved conveyance portion 92 in the sheet conveyance direction and on the upstream side from an intermediate position M2 of the vertical conveyance portion 93 in the sheet conveyance direction.

The fourth conveyance unit 40D is disposed on the downstream side from the third conveyance unit 40C and on the upstream side from the fifth conveyance unit 40E. To be more specific, the fourth conveyance unit 40D is disposed on the downstream side from the intermediate position M2 of the vertical conveyance portion 93 in the sheet conveyance direction and on the upstream side from an intermediate position M3 of the second curved conveyance portion 94 in the sheet conveyance direction.

The fifth conveyance unit 40E is disposed on the downstream side from the fourth conveyance unit 40D. To be more specific, the fifth conveyance unit 40E is disposed on the downstream side from the intermediate position M3 of the second curved conveyance portion 94 in the sheet conveyance direction or on the second horizontal conveyance portion 95.

In the image forming apparatus according to the present embodiment, the sheet P on which an image has been formed by the image forming device 3 is conveyed downstream while being nipped by the rollers 41 and the spur wheels 42 that rotate. At least one of the roller 41 and the spur wheel 42 may be driven to rotate. Accordingly, the sheet P sequentially passes through the first horizontal conveyance portion 91, the first curved conveyance portion 92, the vertical conveyance portion 93, the second curved conveyance portion 94, and the second horizontal conveyance portion 95 and is ejected from the image forming device 3 to the sheet ejection portion 7. Similarly, when the sheet P is conveyed to the drying device 6 or the sheet alignment apparatus 200, the sheet P is also conveyed while being nipped by the rollers 41 and the spur wheels 42.

In the image forming apparatus according to the present embodiment, the sheet P is conveyed by roller pairs (rubber roller pairs) until the sheet P reaches the image forming device 3 from the sheet feed tray 16. However, when the sheet P is conveyed while being sandwiched between a pair of rollers after an image is formed on the sheet P by the image forming device 3, ink is highly likely to be in a liquid state, particularly, immediately after the image is formed on the sheet. Therefore, there is a concern that a roller might contact the ink on the sheet to disturb the ink, thereby degrading image quality. In addition, the ink adhering to the roller might adhere to another sheet to contaminate the sheet.

Accordingly, as illustrated in FIG. 2, in the image forming apparatus according to the present embodiment, the spur wheels 42 are disposed on the side of a liquid applied face Pa (i.e., a surface to which ink I is applied) of the sheet P. Accordingly, even if the spur wheels 42 contact the liquid applied face Pa of the sheet P during conveyance, the contact area of each spur wheel 42 with respect to the liquid applied face Pa is small, thus reducing the disturbance of the ink (image) on the sheet P. Further, adhesion of ink to the spur wheels 42 is restrained, thus reducing smear on the sheet caused by ink being applied from the spur wheels 42 to another sheet.

On the other hand, the rollers 41 contact an opposite face Pb of the sheet P opposite to the liquid applied face Pa. However, in a state in which an image is formed on only one face (front face) of the sheet P, ink is not applied to the opposite face Pb opposite to the liquid applied face Pa. Accordingly, there is no problem even if the rollers 41 come into contact with the opposite face Pb.

However, at the time of duplex printing, ink adheres to both front and back faces of the sheet P. Accordingly, it is preferable that, after an image is formed on the front face of the sheet P, the sheet P is once conveyed to the drying device 6 (see FIG. 1), the image (ink) on the front face is dried, and then an image is formed on the back face. For example, after the drying device 6 has dried the image on the front face of the sheet P, the sheet P is switched back and conveyed in the sheet conveyance passage 25 and the sheet conveyance passage 23 illustrated in FIG. 1. Then, the sheet P is guided to the image forming device 3 via the sheet reverse passage 21. Further, the sheet P may not be conveyed in the sheet conveyance passage 25 and the sheet conveyance passage 23, but may be conveyed toward upstream from the sheet conveyance passage 22 (upstream from the drying device 6) in the sheet conveyance direction via a different sheet conveyance passage that detours the drying device 6 and may be guided to the image forming device 3 via the sheet reverse passage 21. In this manner, the drying process of the image on the front face is performed before the image is formed on the back face. Accordingly, even when the rollers 41 come into contact with the image on the front face after the image is formed on the back face, ink is less likely to adhere to the rollers 41, thus restraining the degradation of the image quality due to the contact of the rollers 41. Also in this case, since the spur wheels 42 come into contact with the back face that is the liquid applied face Pa (before the drying process), the disturbance of the ink (image) on the sheet P is reduced as in the case of simplex printing.

Note that, since ink is adhered to the front and back faces of the sheet P during the duplex printing, both the front and back faces of the sheet P may be referred to as liquid applied faces. However, in the present disclosure, the "liquid applied face" with which the spur wheels 42 come into contact when images are formed on both faces means the back face on which an image is formed for the second time. Therefore, the "liquid applied face" referred to in the description of the present disclosure represents the face on which liquid is applied (front face) when the sheet P has the liquid on a single face or the face on which liquid is applied for the second time (back face) when the sheet P has the liquid on both the front and back faces.

As described above, in the image forming apparatus according to the present embodiment, the spur wheels 42 are disposed on the side facing the liquid applied face Pa of the sheet P, thus reducing disturbance of ink on the sheet P in both cases of simplex printing and duplex printing. However, even in the configuration using the spur wheels 42, the sheet P is highly likely to be in a wet state due to the moisture of ink on the upstream side of the conveyance passage 90. Accordingly, when the spur wheels 42 strongly contact the liquid applied face Pa of the sheet P, the ink on the sheet P might be disturbed or the contact trace of the spur wheels 42 might be formed on the sheet P.

Hence, in the image forming apparatus according to the present embodiment, in order to reduce the contact pressure of the spur wheels 42 with respect to the sheet P particularly on the upstream side, the contact pressure of the rollers 41 and the spur wheels 42 each other is set to be smaller on the upstream side than on the downstream side of the conveyance passage 90. For example, in the present embodiment, the contact pressure Fd of the fourth conveyance unit 40D is smaller than the contact pressure Fe of the fifth conveyance unit 40E. The contact pressure Fc of the third conveyance unit 40C is smaller than the contact pressure Fd of the fourth conveyance unit 40D. The contact pressure Fb of the second conveyance unit 40B is smaller than the contact pressure Fc of the third conveyance unit 40C (Fe>Fd>Fc>Fb). In other words, in the present embodiment, the contact pressure between the roller 41 and the spur wheel 42 decreases toward the upstream side.

As described above, in the image forming apparatus according to the present embodiment, the contact pressure between the roller 41 and the spur wheel 42 is smaller on the upstream side than on the downstream side of the conveyance passage 90. Accordingly, the contact pressure of the spur wheel 42 against the sheet P is smaller on the upstream side than on the downstream side. Such a configuration can prevent the spur wheel 42 from being strongly pressed against the sheet P on the upstream side. Even if the spur wheel 42 comes into contact with the sheet P, such a configuration can prevent the ink on the sheet P from being disturbed or the sheet P from having a contact trace.

The contact pressure Fa of the first conveyance unit 40A may be smaller than the contact pressure Fb of the second conveyance unit 40B (Fa<Fb) or may be equal to the contact pressure Fb of the second conveyance unit 40B (Fa=Fb). In this way, the relationship in which the contact pressure of the conveyance unit is smaller on the upstream side than on the downstream side may not be established in all of the conveyance units 40A to 40E disposed in the conveyance passage 90. In other words, the relationship in which the contact pressure is smaller on the upstream side than on the downstream side may be established between one on the upstream side and the other on the downstream side among at least any two conveyance units selected in the plurality of conveyance units that convey the sheet to which the liquid is applied. In addition, the magnitude relationship of the contact pressure may not necessarily be established between the conveyance units adjacent to each other in the sheet conveyance direction. For example, if the contact pressure of the second conveyance unit 40B on the upstream side is smaller than the contact pressure of the fourth conveyance unit 40D on the downstream side, the contact pressure of the third conveyance unit 40C disposed between the second conveyance unit 40B and the fourth conveyance unit 40D may be equal to the contact pressure of the second conveyance unit 40B or the fourth conveyance unit 40D.

In the image forming apparatus according to the present embodiment, the sheet P is conveyed upward when the sheet P passes through the vertical conveyance portion 93 illustrated in FIG. 2. When the sheet P is conveyed upward, a larger conveying force is required than when the sheet P is conveyed in the horizontal direction. Therefore, particularly in the second conveyance unit 40B and the third conveyance unit 40C that convey the sheet P upward, a conveying force for conveying the sheet P is needed.

However, when the contact pressure between the roller 41 and the spur wheel 42 on the upstream side is reduced as described above, the force for nipping the sheet P by the roller 41 and the spur wheel 42 decreases, and thus the conveying force for conveying the sheet P decreases on the upstream side. As a result, the behavior of the sheet P on the upstream side might be unstable, and a conveyance failure might occur.

Hence, in the image forming apparatus according to the present embodiment, in order to secure the conveying force on the upstream side and enhance the conveying performance, the interval between the conveyance units arranged in the sheet conveyance direction is set to be smaller on the upstream side than on the downstream side. For example, in the present embodiment, the interval Gc-d between the third conveyance unit 40C and the fourth conveyance unit 40D is smaller than the interval Gd-e between the fourth conveyance unit 40D and the fifth conveyance unit 40E illustrated in FIG. 2. The interval Gb-c between the second conveyance unit 40B and the third conveyance unit 40C is smaller than the interval Gc-d between the third conveyance unit 40C and the fourth conveyance unit 40D (Gd-e>Gc-d>Gb-c). In other words, in the present embodiment, the interval between the conveyance units decreases toward the upstream side. Here, the "interval between the conveyance units" means an interval in the sheet conveyance direction between the rollers 41 or the spur wheels 42 adjacent to each other in the sheet conveyance direction. Alternatively, the "interval between the conveyance units" may be from the contact position between the roller 41 on the upstream side in the sheet conveyance direction and the sheet P to the contact position between the adjacent roller 41 on the downstream side and the sheet P. Alternatively, the "interval between the conveyance units" may be from the contact position between the spur wheel 42 on the upstream side in the sheet conveyance direction and the sheet P to the contact position between the adjacent spur wheel 42 on the downstream side and the sheet P.

As described above, in the image forming apparatus according to the exemplary embodiment, the interval between the conveyance units is set to be smaller on the upstream side than on the downstream side, thus allowing the conveying force and the conveying performance to be enhanced on the upstream side. In other words, since the interval between the conveyance units is smaller on the upstream than on the downstream side, the number of rollers 41 and spur wheels 42 that nip the sheet P increases and the sheet P is nipped at a narrower interval. Such a configuration can obtain a sufficient conveying force and restrain fluttering of the sheet P, thus allowing the behavior of the sheet P to be stabilized Thus, the conveying performance on the upstream side can be enhanced, thus restraining a conveyance failure.

On the other hand, on the downstream side of the conveyance passage 90, the interval between the conveyance units is greater. Accordingly, the number of times the spur wheels 42 come into contact with the sheet P can be reduced compared to the upstream side. Such a configuration can restrain the contact trace of the spur wheels 42 from being formed on the sheet P. Further, as the sheet P is conveyed toward the downstream side, the drying of the ink on the sheet P progresses and the behavior of the sheet P is stabilized. Accordingly, even when the interval between the conveyance units is increased on the downstream side, the sheet P can be stably conveyed.

In the present embodiment, the distance Ga-b between the first conveyance unit 40A and the second conveyance unit 40B is set to be larger than the distance Gb-c between the second conveyance unit 40B and the third conveyance unit 40C (Gb-c<Ga-b). In other words, contrary to the size relationship of the interval between other conveyance units, the interval Ga-b on the upstream side is set to be larger than the interval Gb-c on the downstream side. However, unlike the second conveyance unit 40B and the third conveyance unit 40C, the first conveyance unit 40A conveys the sheet P horizontally, thus allowing the sheet P to be stably conveyed without increasing the conveying force. Accordingly, as in the present embodiment, even when the interval Ga-b between the first conveyance unit 40A and the second conveyance unit 40B is set to be larger than the interval Gb-c between the second conveyance unit 40B and the third conveyance unit 40C, there is no problem in the conveying performance. In addition, similarly to the size relationship of the intervals between the other conveyance units, the interval Ga-b between the first conveyance unit 40A and the second conveyance unit 40B may be set to be smaller than the interval Gb-c between the second conveyance unit 40B and the third conveyance unit 40C (Gb-c>Ga-b).

As described above, the interval between the conveyance units may be set according to the shape of the conveyance passage, the conveying direction, and the like. Therefore, the relationship in which the interval between the conveyance units is smaller on the upstream side than on the downstream side may not be established in all the intervals between the conveyance units 40A to 40E arranged in the conveyance passage 90. In other words, the relationship in which the interval between the conveyance units is smaller on the upstream side than on the downstream side may be established between one on the upstream side and the other on the downstream side among at least any two intervals selected. In addition, the size relationship of the intervals between the conveyance units does not necessarily have to be established between the intervals adjacent to each other in the sheet conveyance direction. For example, if the interval Gb-c between the second conveyance unit 40B and the third conveyance unit 40C on the upstream side is smaller than the interval Gd-e between the fourth conveyance unit 40D and the fifth conveyance unit 40E on the downstream side, the interval Gc-d between the third conveyance unit 40C and the fourth conveyance unit 40D between the second conveyance unit 40B and the fifth conveyance unit 40E may be equal to the interval Gb-c on the upstream side or the interval Gd-e on the downstream side.

Next, another configuration that enhances the conveying performance is described.

Figure 7:
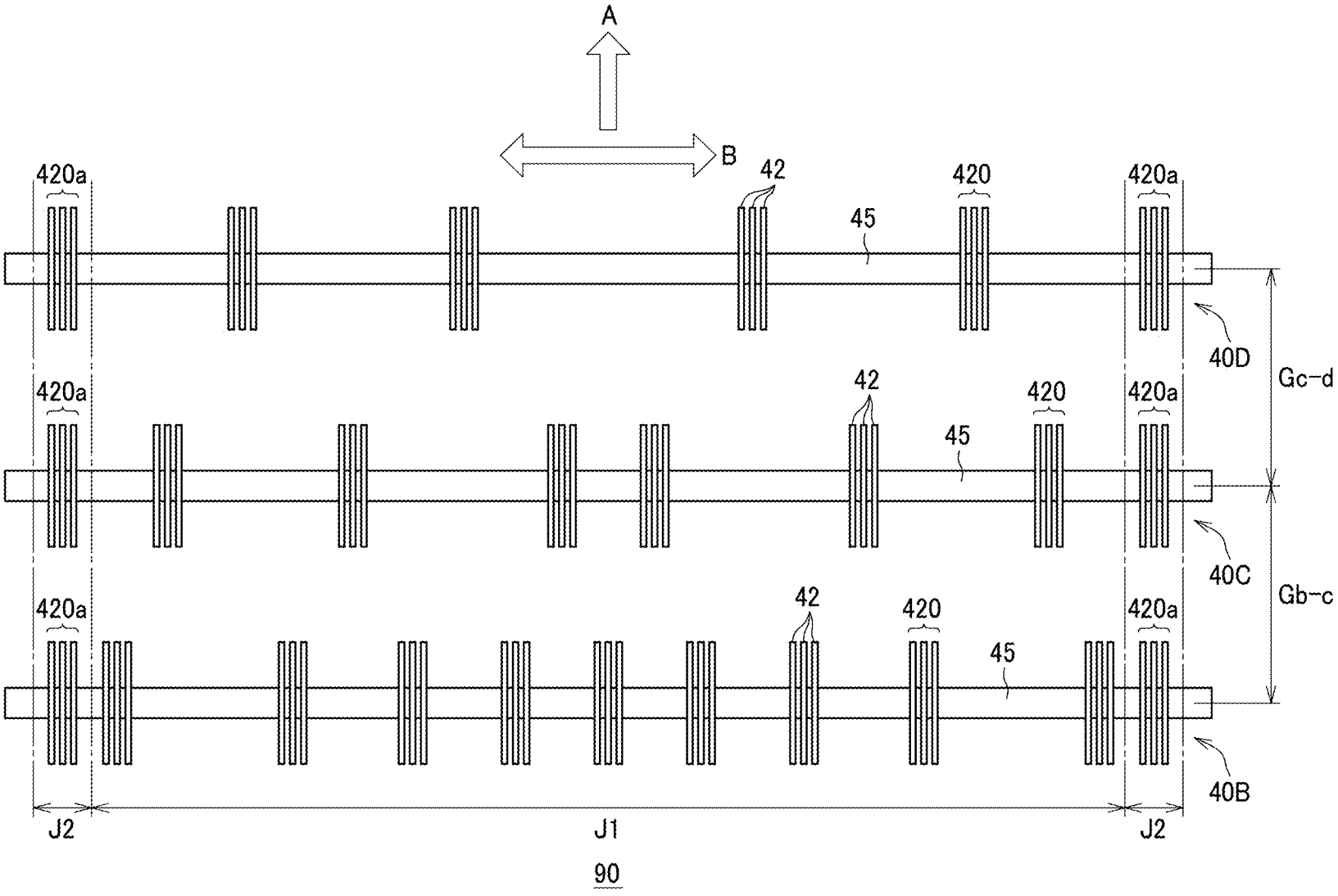
FIG. 7 is a diagram illustrating an example in which the number of spur wheels is increased on the upstream side in a sheet conveyance direction.

FIG. 7 is a view of the second conveyance unit 40B, the third conveyance unit 40C, and the fourth conveyance unit 40D arranged on the conveyance passage 90 as viewed from a direction orthogonal to the axial direction. In FIG. 7, the direction indicated by arrow A indicates a sheet conveyance direction (hereinafter may referred to as sheet conveyance direction A), and the direction indicated by arrow B indicates a sheet width direction (hereinafter may referred to as sheet width direction B) intersecting the sheet conveyance direction A along the conveyance passage. Further, in the present embodiment, similarly to the embodiment illustrated in FIG. 2, in order to restrain the disturbance of ink on the sheet P and the contact trace of the spur wheel 42, the contact pressure between the roller 41 and the spur wheel 42 that are in contact with each other is set to be smaller on the upstream side than on the downstream side of the conveyance passage 90.

In the present embodiment, as illustrated in FIG. 7, the number of the spur wheels 42 (or spur wheel groups 420) arranged in the sheet width direction B is set to be larger on the upstream side than on the downstream side in order to restrain the reduction in the conveying force and the conveying performance due to the reduction in the contact pressure of the conveyance unit on the upstream side. For example, in the present embodiment, the number Hc of the spur wheels 42 of the third conveyance unit 40C is larger than the number Hd of the spur wheels 42 of the fourth conveyance unit 40D. The number Hb of the spur wheels 42 of the second conveyance unit 40B is larger than the number Hc of the spur wheels 42 of the third conveyance unit 40C (Hd<Hc<Hb). In other words, in the present embodiment, the number of the spur wheels 42 increases toward the upstream side.

As described above, in the embodiment illustrated in FIG. 7, the number of the spur wheels 42 arranged in the sheet width direction B is set to be larger on the upstream side than on the downstream side. Thus, the conveying force and the conveying performance on the upstream side can be enhanced. In other words, since the number of spur wheels 42 to nip the sheet P with the rollers 41 is large on the upstream side, a sufficient conveying force can be obtained compared to the downstream side. The sheet P is less likely to flutter, so that the behavior of the sheet P can be stabilized. Thus, the conveying performance on the upstream side can be enhanced, thus effectively restraining conveyance failure.

The number of spur wheels 42 included in the first conveyance unit 40A and the fifth conveyance unit 40E, which are not illustrated in FIG. 7, may be set according to the above-described relationship. In other words, the number Ha of the spur wheels 42 included in the first conveyance unit 40A on the upstream side may be larger than the number Hb of the spur wheels 42 included in the second conveyance unit 40B on the downstream side (Hb<Ha). The number He of the spur wheels 42 included in the fifth conveyance unit 40E on the downstream side may be smaller than the number Hd of the spur wheels 42 included in the fourth conveyance unit 40D on the upstream side (He<Hd). Unlike the second conveyance unit 40B and the third conveyance unit 40C, the first conveyance unit 40A only needs to have a conveying force to horizontally convey the sheet P. Therefore, the number Ha of the spur wheels 42 of the first conveyance unit 40A may not be larger than the number of the spur wheels 42 of the conveyance unit on the downstream side. Accordingly, the number Ha of the spur wheels 42 included in the first conveyance unit 40A may be equal to the number Hb of the spur wheels 42 included in the second conveyance unit 40B (Hb=Ha).

As described above, the number of the spur wheels 42 included in the conveyance unit may be set according to the shape of the conveyance passage, the conveyance direction, and the like. Therefore, the relationship in which the number of the spur wheels 42 included in the conveyance unit is larger on the upstream side than on the downstream side may not be established in all of the conveyance units 40A to 40E disposed in the conveyance passage 90. In other words, the relationship in which the number of the spur wheels 42 included in the conveyance unit is larger on the upstream side than on the downstream side may be established between one on the upstream side and the other on the downstream side among at least two conveyance units arbitrarily selected. In addition, the magnitude relationship of the number of the spur wheels 42 may not necessarily be established between the conveyance units adjacent to each other in the sheet conveyance direction. For example, if the number of the spur wheels 42 included in the second conveyance unit 40B on the upstream side is larger than the number of the spur wheels 42 included in the fourth conveyance unit 40D on the downstream side, the number of the spur wheels 42 included in the third conveyance unit 40C disposed between the second conveyance unit 40B and the fourth conveyance unit 40D may be the same as the number of the spur wheels 42 included in the second conveyance unit 40B or the fourth conveyance unit 40D.

As described above, in the embodiment illustrated in FIG. 7, the number of the spur wheels 42 included in the conveyance unit is set to be larger on the upstream side than on the downstream side. Such a configuration can enhance the conveying force and the conveying performance on the upstream side and effectively restrain the conveyance failure. On the other hand, since the number of the spur wheels 42 included in the conveyance unit is smaller on the downstream side than on the upstream side, the number of contact portions of the spur wheels 42 with respect to the sheet P is reduced, thus restraining the generation of contact trace.

Furthermore, in the present embodiment, in order to more effectively restrain the generation of contact trace, as illustrated in FIG. 7, the positions of the spur wheels 42 are set to be different between the upstream side and the downstream side in the sheet width direction B. For example, in the present embodiment, among the spur wheels 42 included in each of the second conveyance unit 40B, the third conveyance unit 40C, and the fourth conveyance unit 40D, all spur wheels 42 except for the spur wheel groups 420*a* at both ends in the axial direction are disposed at different positions in the sheet width direction B.

In this manner, the positions of the spur wheels 42 are different between the upstream side and the downstream side in the sheet width direction B. Such a configuration can prevent the spur wheels 42 from coming into contact with the same position on the sheet (in other words, a position at which the spur wheels 42 overlap with each other in the sheet conveyance direction A). Accordingly, such a configuration can prevent the spur wheels 42 from repeatedly coming into contact with the same portion on the sheet and restrain a decrease in image quality.

In addition, in a case in which both a liquid applied region to which ink is actually applied and a non-liquid applied region to which ink is not applied are on the liquid applied face of a sheet, as illustrated in FIG. 7, it is preferable that the positions of the spur wheels 42 are different between the upstream side and the downstream side in the sheet width direction B at least in an applied-region passing range J1 that the liquid applied region passes. In other words, the contact traces of the spur wheels 42 are likely to be generated in the liquid applied region on which ink (liquid) is applied and the rigidity of the sheet is decreased. Accordingly, the positions of the spur wheels 42 in the applied-region passing range J1, in which the contact trace is likely to be generated, are set to be different at least between the upstream side and the downstream side in the sheet width direction B. Such a configuration can effectively restrain the generation of the contact traces.

Further, in the embodiment illustrated in FIG. 7, the positions of all the spur wheels 42 are set to be different between the upstream side and the downstream side in the sheet width direction B, within the maximum applied-region passing range J1 through which the maximum liquid applied region in which the liquid can be applied to the sheet passes. Such a configuration can prevent the spur wheels 42 from repeatedly coming into contact with the same portion of the sheet over the entire region in which the contact trace is likely to be generated, thus more effectively restraining the generation of the contact trace.

On the other hand, the spur wheels 42 (or the spur wheel groups 420*a*) disposed in each of non-applied-region passing ranges J2 that are sheet passing ranges other than the applied-region passing range J1 illustrated in FIG. 7 comes into contact with a portion of the sheet to which the liquid is not applied. Accordingly, the contact traces of the spur wheels 42 are less likely to be generated in the non-applied-region passing ranges J2. Therefore, the positions of the spur wheels 42 disposed in each of the non-applied-region passing ranges J2 may not be different between the upstream side and the downstream side in the sheet width direction B. Thus, as illustrated in FIG. 7, the positions of the spur wheels 42 (or the spur wheel groups 420*a*) disposed in each of the non-applied-region passing ranges J2 may be the same between the upstream side and the downstream side in the sheet width direction B.

In addition, since the contact traces of the spur wheels 42 are less likely to occur in the non-applied-region passing ranges J2, the contact pressure between the roller 41 and the spur wheel 42 disposed in the non-applied-region passing range J2 can be set to be larger than the contact pressure between the roller 41 and the spur wheel 42 disposed in the applied-region passing range J1. Such a configuration can ensure the conveying force while restraining the deterioration of the image quality and the generation of the contact trace in the applied-region passing range J1.

The range in which the positions of the spur wheels 42 are set to be different between the upstream side and the downstream side in the sheet width direction B may be a part of the maximum applied-region passing range J1. Such a configuration can also restrain the contact trace of the spur wheel 42 from becoming conspicuous in a partial range. Accordingly, as in the example illustrated in FIG. 8, some of the spur wheels 42 (or the spur wheel group 420*b*) included in the second conveyance unit 40B and some of the spur wheels 42 (or the spur wheel group 420*c*) included in the fourth conveyance unit 40D may be disposed at the same position in the sheet width direction B.

Figure 8:
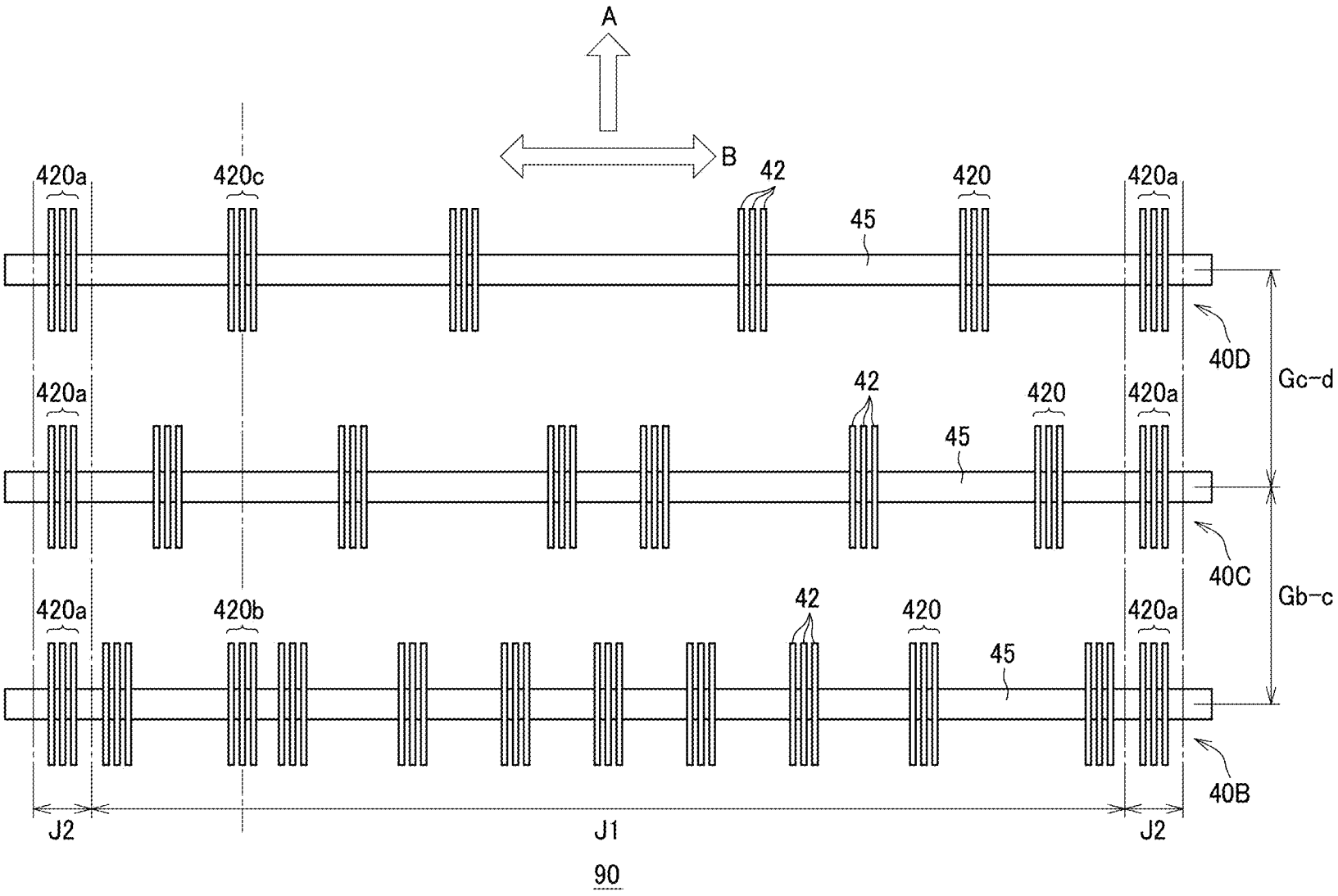
FIG. 8 is a diagram illustrating an example in which the positions of some spur wheels on the upstream side in the sheet conveyance direction are the same as the positions of other spur wheels on the downstream side in the sheet conveyance direction.
Figure 9:
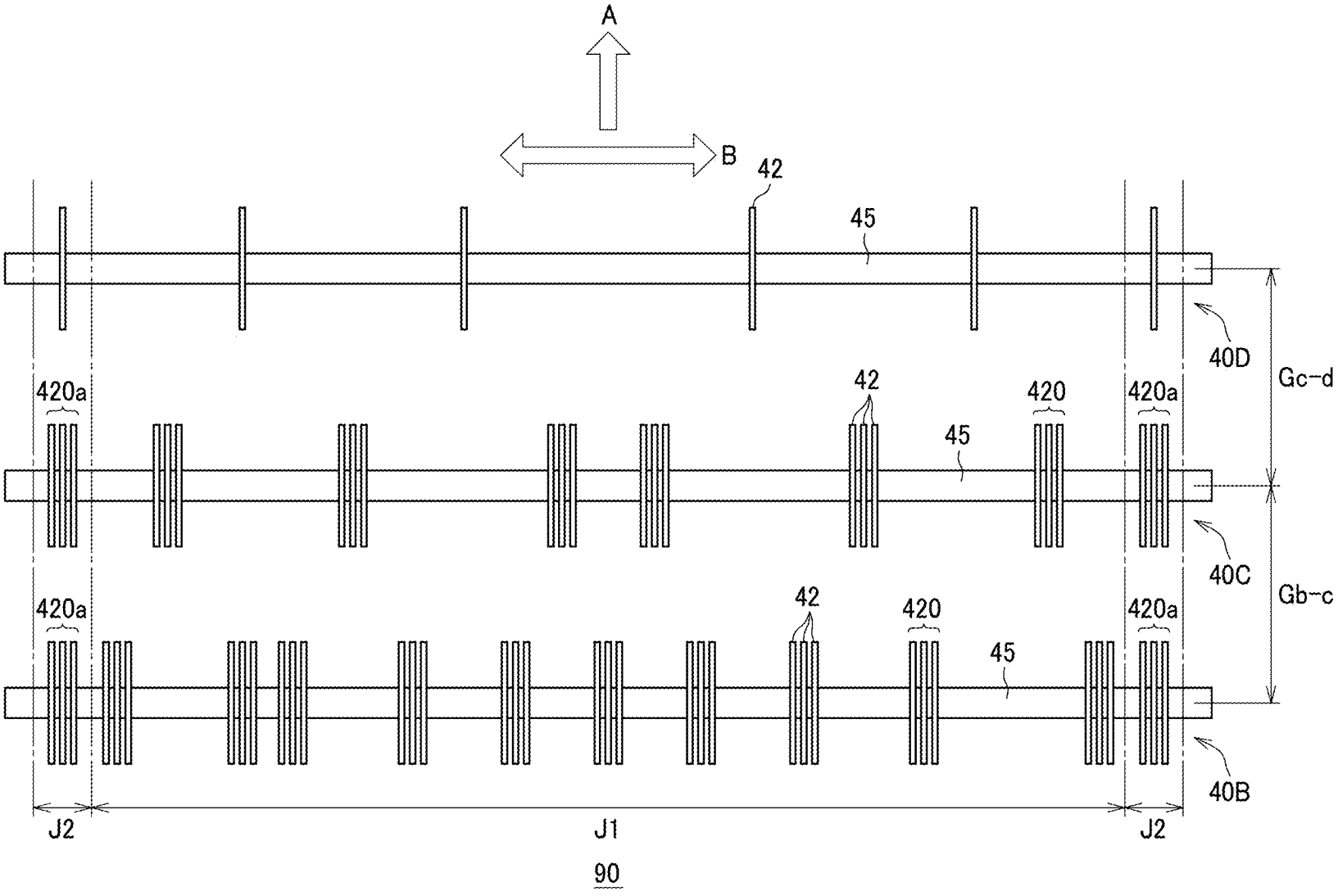
FIG. 9 is a diagram illustrating an example in which each spur wheel group in a part of conveyance units is replaced with a single spur wheel.

In FIG. 9, each of the spur wheel groups 420 of the fourth conveyance unit 40D in the example illustrated in FIG. 8 is replaced with a single spur wheel 42. Also in this case, since the number of the spur wheels 42 included in the conveyance unit is larger on the upstream side than on the downstream side, the conveying performance on the upstream side can be enhanced. In addition, each spur wheel group 420 may be replaced with a single spur wheel 42 not only in the fourth conveyance unit 40D but also in the second conveyance unit 40B and the third conveyance unit 40C. In other words, if the number of single spur wheels 42 included in each conveyance unit is larger on the upstream side than on the downstream side, the conveying performance on the upstream side can be enhanced.

The method of adjusting the interval between the conveyance units (the example illustrated in FIG. 2) and the method of adjusting the number of spur wheels 42 included in the conveyance unit (the examples illustrated in FIGS. 7, 8, and 9) have been described above as measures for enhancing the conveying performance on the upstream side. In the examples illustrated in FIGS. 2, 7, 8, and 9 described above, only one of the above-described methods is used. However, in some embodiments, both the methods may be used together.

Figure 10:
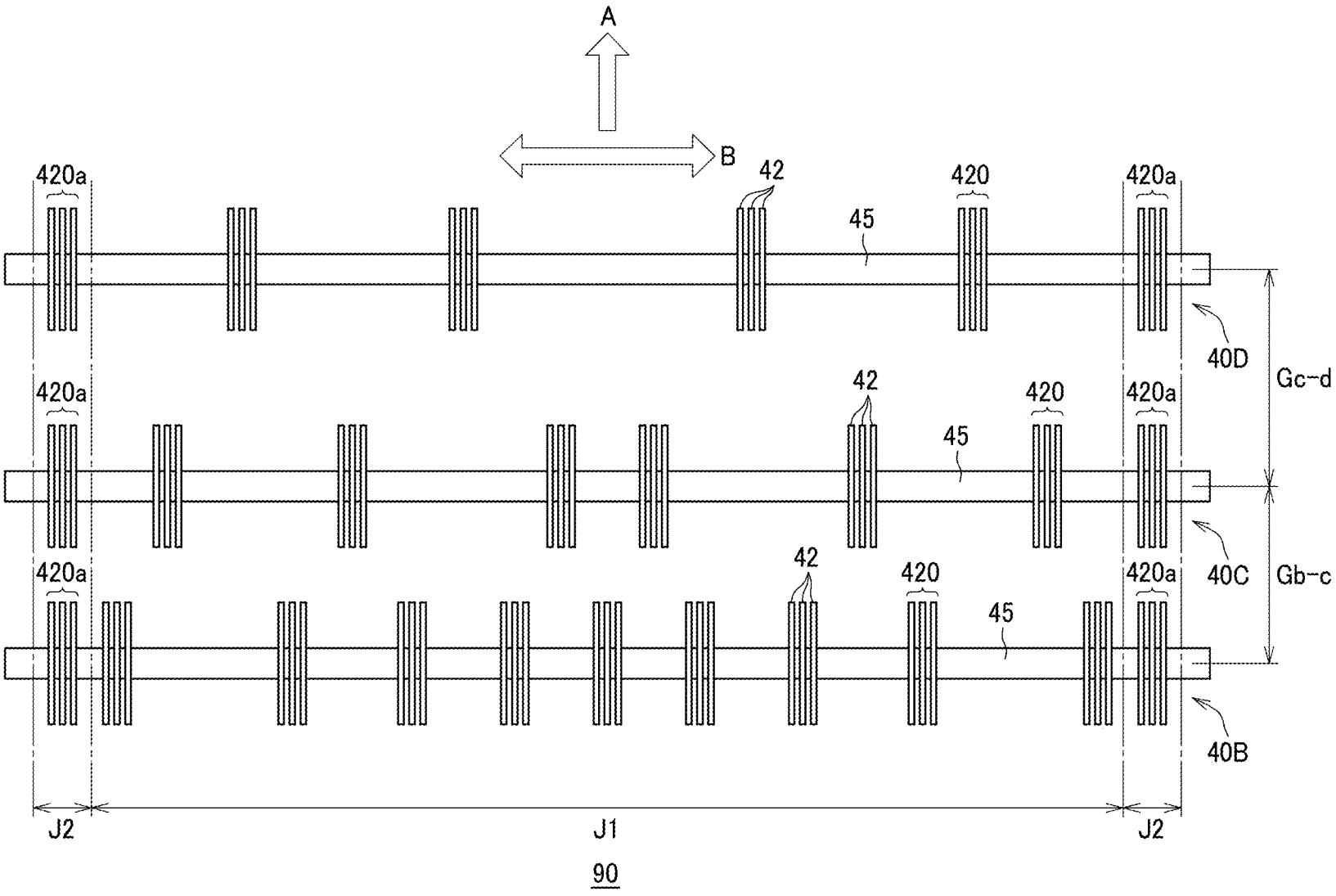
FIG. 10 is a diagram illustrating an example in which the number of spur wheels is increased on the upstream side in the sheet conveyance direction and the interval between conveyance units is decreased on the upstream side.

Therefore, as in the example illustrated in FIG. 10, the number of the spur wheels 42 may be larger on the upstream side than on the downstream side, and the interval between the conveyance units may be smaller on the upstream side than on the downstream side (Gc-d>Gb-c). Thus, the conveying performance on the upstream side can be further enhanced, and conveyance failure can be more effectively restrained.

Further, as a conveyance unit provided in a conveying device according to an embodiment of the present disclosure, for example, a conveyance unit having the following configuration can be adopted.

Figure 11:
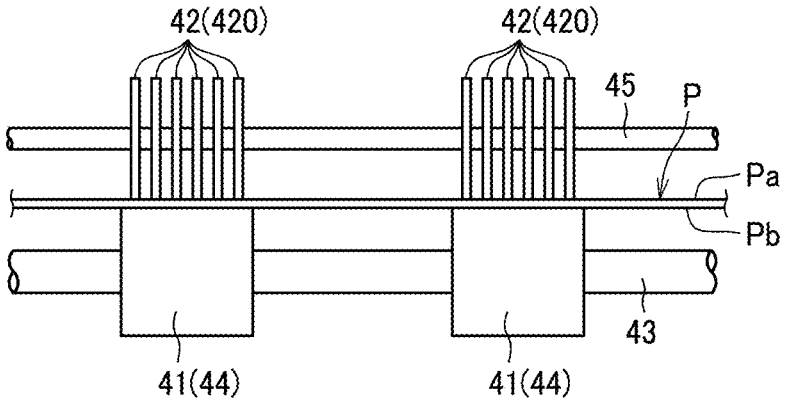
FIG. 11 is a diagram illustrating an example in which rollers are arranged intermittently in the axial direction corresponding to the positions of spur wheels.
Figure 12:
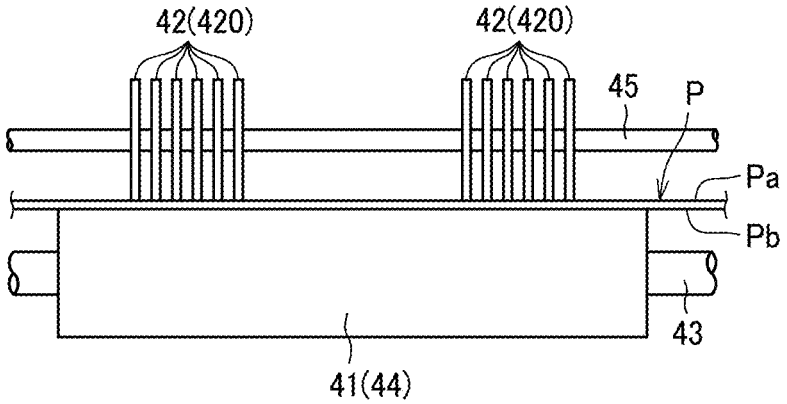
FIG. 12 is a diagram illustrating an example in which a roller is continuously arranged so as to include portions corresponding to spur wheels and portions not corresponding to spur wheels.
Figure 13:
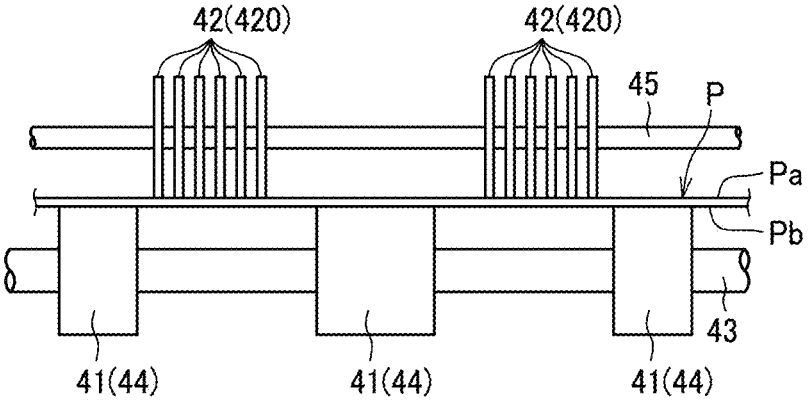
FIG. 13 is a diagram illustrating an example in which rollers and spur wheels are shifted in the axial direction so as not to contact each other.

In the conveyance unit, the roller 41 and the spur wheel 42 may be arranged so as to contact each other as in the examples illustrated in FIGS. 11 and 12 or may be shifted in the axial direction so as not to contact each other as in the example illustrated in FIG. 13. Further, the rollers 41 may be intermittently arranged corresponding to the positions at which the spur wheels 42 are disposed as in the example illustrated in FIG. 11. Alternatively, the roller 41 may be continuously arranged so as to include portions not corresponding to the spur wheels 42 in addition to portions corresponding to the spur wheels 42 as in the example illustrated in FIG. 12. In particular, in the case of the example illustrated in FIG. 12, the contact range between the roller 41 and the sheet P increases, thus allowing the sheet P to be stably conveyed even when the contact pressure between the roller 41 and the spur wheel 42 is small. Therefore, the example illustrated in FIG. 12 is suitable as the configuration of the second conveyance unit 40B and the third conveyance unit 40C on the upstream side that requires a certain conveying force. On the other hand, the examples illustrated in FIGS. 11 and 13 can be applied to the fifth conveyance unit 40E on the downstream side that does not require much conveying force.

Figure 14:
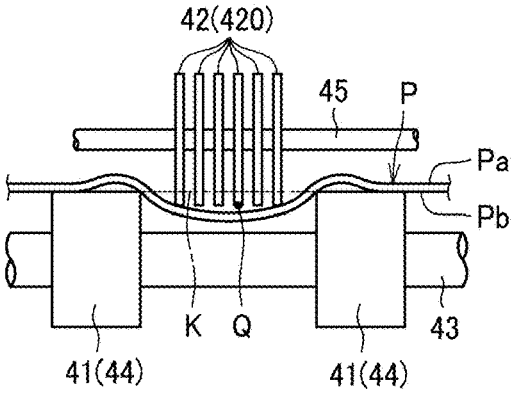
FIG. 14 is a diagram illustrating an example in which spur wheels enter in an inner diameter direction of a roller beyond an outer peripheral surface of the roller.

The example illustrated in FIG. 14 is an example in which, in the example illustrated in FIG. 13, the distal ends Q of the spur wheels 42 in the outer diameter direction further enters the inner diameter side (the side closer to the support shaft 43) of the roller 41 beyond the positions K of the outer peripheral surfaces of the rollers 41. In such a case, the sheet P can be conveyed while being curved. Accordingly, even if cockling (waving) occurs in the sheet P, the sheet P can be conveyed while being bent in the direction opposite to the bending direction of the cockling. Thus, the cockling can be corrected.

Figure 15:
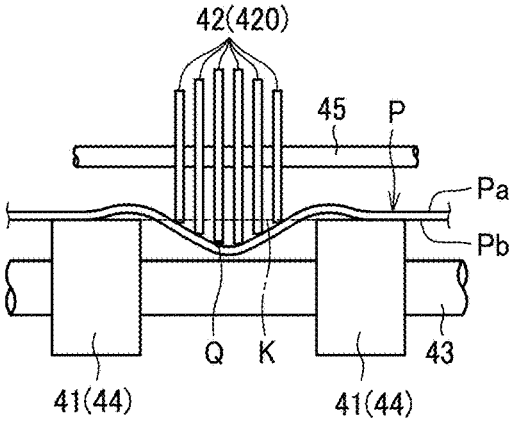
FIG. 15 is a diagram illustrating an example in which distal ends of spur wheels are arranged in a curved line.

Furthermore, in the example illustrated in FIG. 15, the positions of the distal ends Q of the spur wheels 42 in the outer diameter direction are different in the radial direction. In such a case, the distal ends Q of the respective spur wheels 42 in the outer diameter direction are arranged in a curved shape so as to protrude toward the inner diameter side of the roller 41 from both end sides of the spur wheel group 420 in the axial direction toward the center side in the axial direction. Accordingly, since the curvature of the sheet P bent by the spur wheels 42 can be gentle (small), the load on the sheet P can be reduced. Thus, damage to the sheet P and deterioration in image quality can be restrained.

Figure 16:
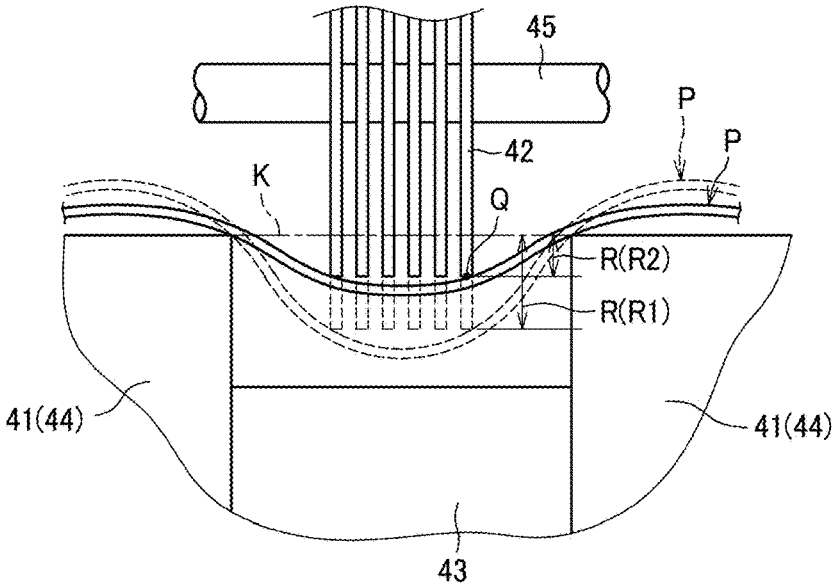
FIG. 16 is a diagram illustrating the amount of entry of spur wheels.

Further, as in the examples illustrated in FIGS. 13, 14, and 15, in the configuration in which the roller 41 and the spur wheel 42 are not in contact with each other, the contact pressure and the conveying force of the spur wheel 42 with respect to the sheet P can be adjusted by changing the amount of entry of the spur wheel 42 into the inner diameter direction beyond the outer peripheral surface of the roller 41. In other words, as illustrated by broken lines in FIG. 16, when the entry amount R of the distal end Q of the spur wheel 42 into the inner radial direction of the roller 41 beyond the position K on the outer circumferential surface of the roller 41 is large (R1), the sheet P is bent along the spur wheel 42 by a larger amount than when the entry amount R is small (R2). Thus, the sheet holding force between the rollers 41 and the spur wheels 42 can be increased. Accordingly, the conveying force for conveying the sheet P is increased, and the conveying performance is enhanced.

In this way, in the case of the configuration in which the rollers 41 and the spur wheels 42 do not contact each other, the entry amount R of the spur wheel 42 is set to be smaller on the upstream side than on the downstream side, thus allowing the contact pressure of the spur wheels 42 with respect to the sheet P to be set to be smaller on the upstream side. Further, the entry amount R of the spur wheel 42 may be gradually decreased toward the upstream side.

In addition, as illustrated in FIG. 7, in the configuration in which the rollers 41 and the spur wheels 42 are disposed in both of the applied-region passing range J1 and the non-applied-region passing range J2, the entry amount R of the spur wheels 42 disposed in the non-applied-region passing range J2 is set to be larger than the entry amount R of the spur wheels 42 disposed in the applied-region passing range J1, thus allowing the conveying force in the non-applied-region passing range J2 to be ensured.

Figure 17:
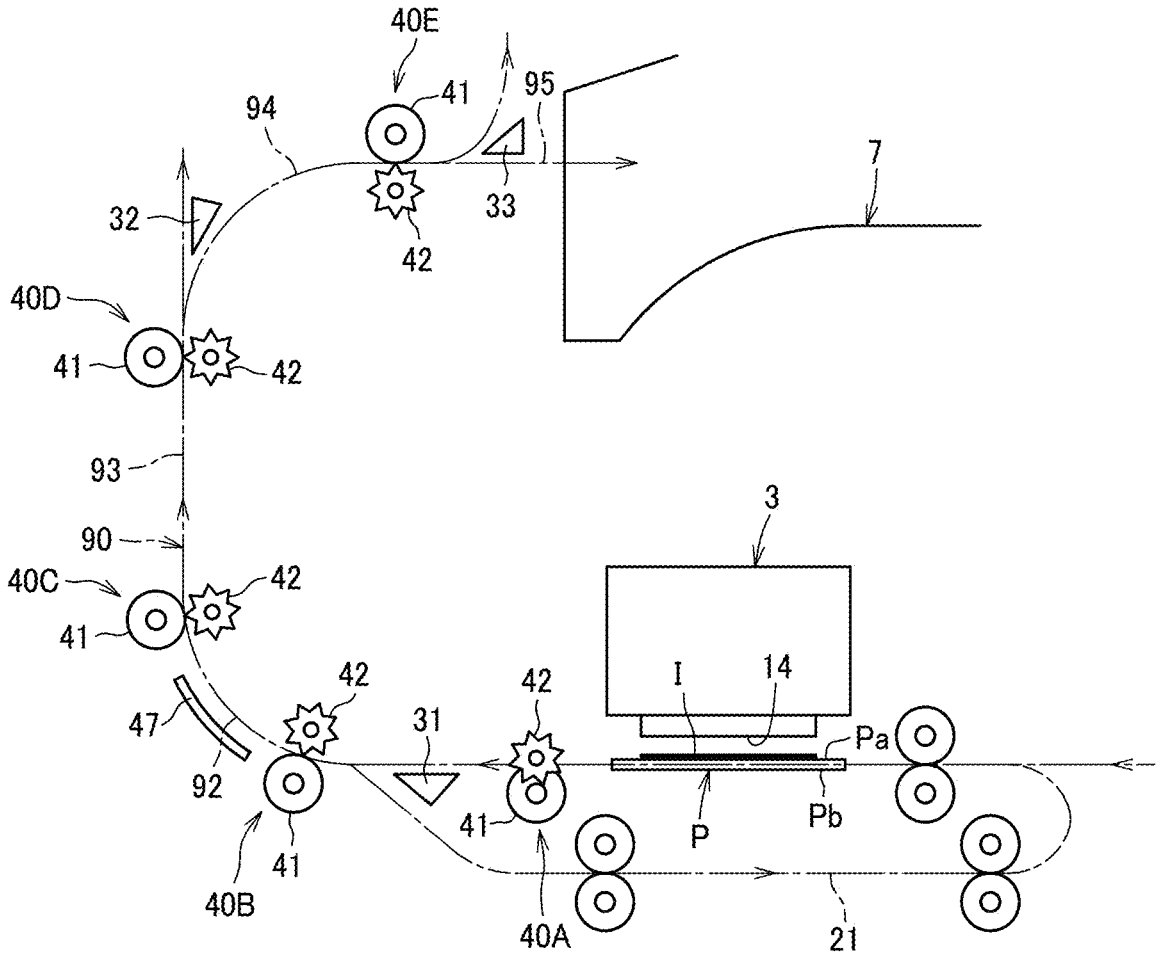
FIG. 17 is a diagram illustrating an example of a conveyance passage in which both a set of rollers and spur wheels that contact each other and a set of rollers and spur wheels that do not contact each other are disposed.

In addition, as the rollers 41 and the spur wheels 42 disposed in the conveyance passage 90, both of the configuration in which rollers 41 and spur wheels 42 contact each other and the configuration in which rollers 41 and spur wheels 42 are shifted in the axial direction and do not contact each other may be used together. For example, as in the example illustrated in FIG. 17, the most upstream first conveyance unit 40A may include rollers 41 and spur wheels 42 that do not contact each other, and the other conveyance unit 40B, 40C, 40D, and 40E may include rollers 41 and spur wheels 42 that contact each other.

Figure 18:
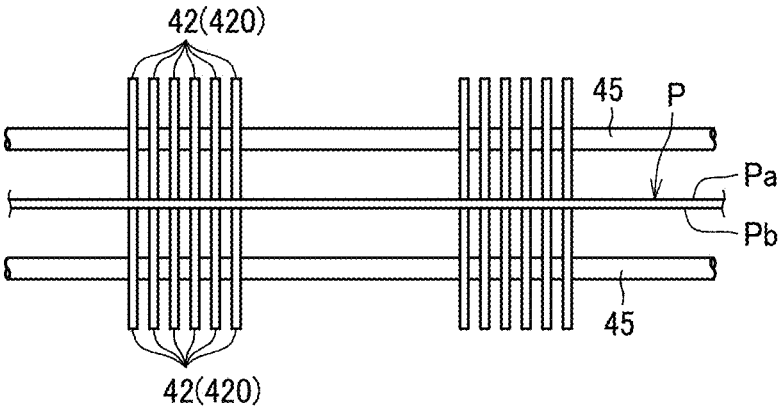
FIG. 18 is a diagram illustrating an example in which spur wheels contact each other.
Figure 19:
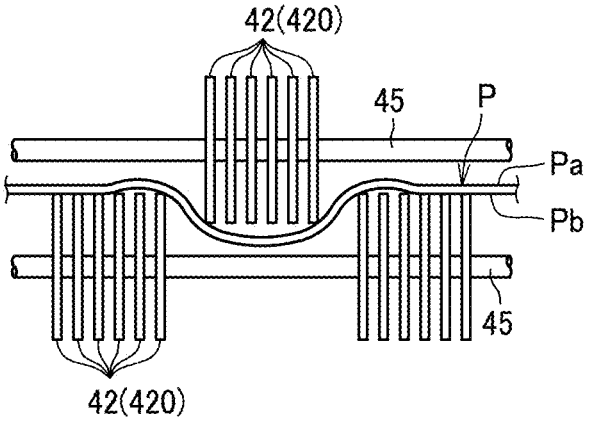
FIG. 19 is a diagram illustrating an example in which spur wheels are shifted in the axial direction and do not contact each other.

Further, a conveyance unit provided in a conveying device according to an embodiment of the present disclosure may have a configuration in which the spur wheels 42 are in contact with each other as illustrated in FIG. 18, or a configuration in which the spur wheels 42 are arranged so as to be shifted from each other in the axial direction as illustrated in FIG. 19.

Figure 20:
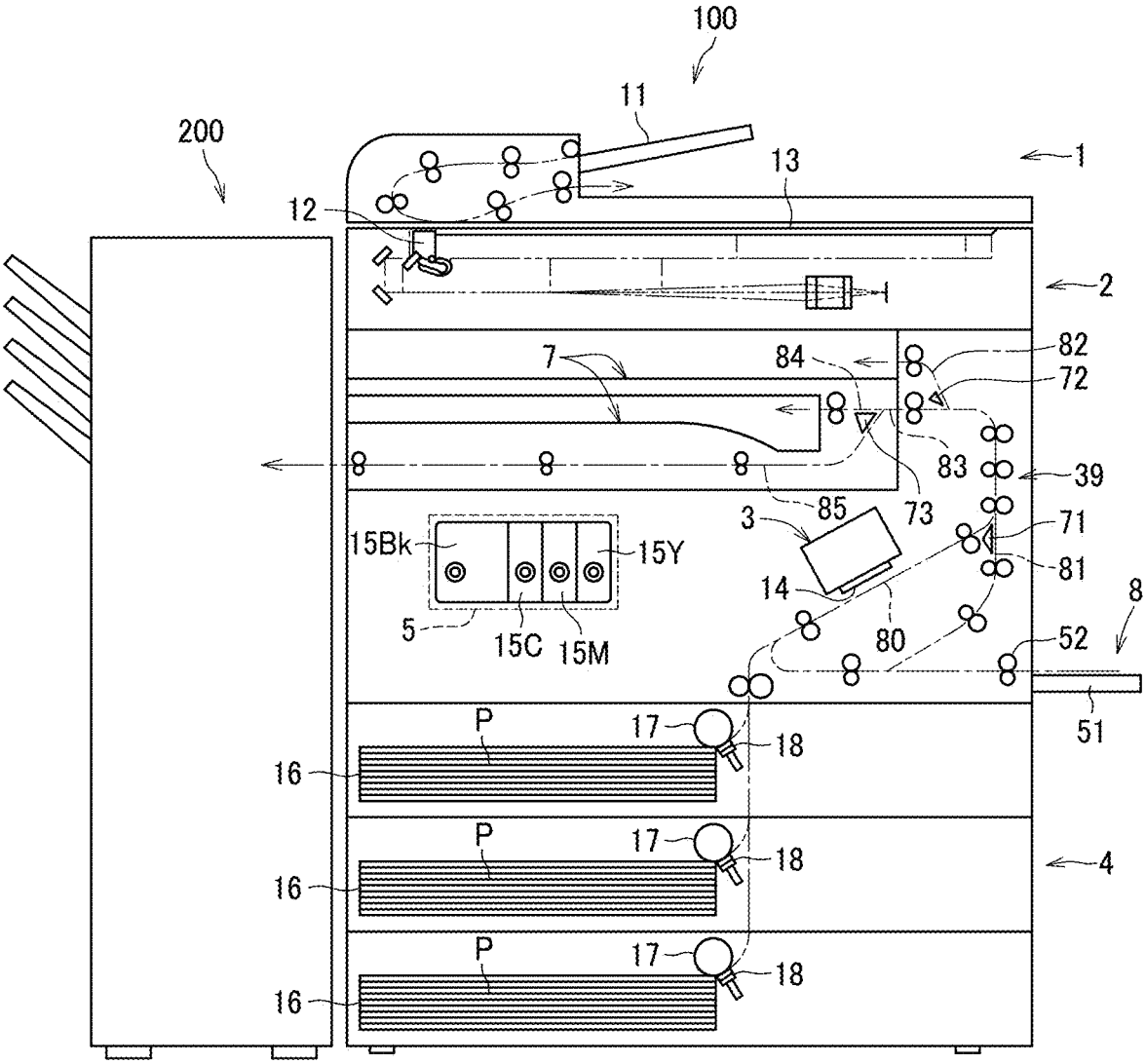
FIG. 20 is a diagram illustrating another example of an image forming apparatus including a conveying device according to an embodiment of the present disclosure.
Figure 21:
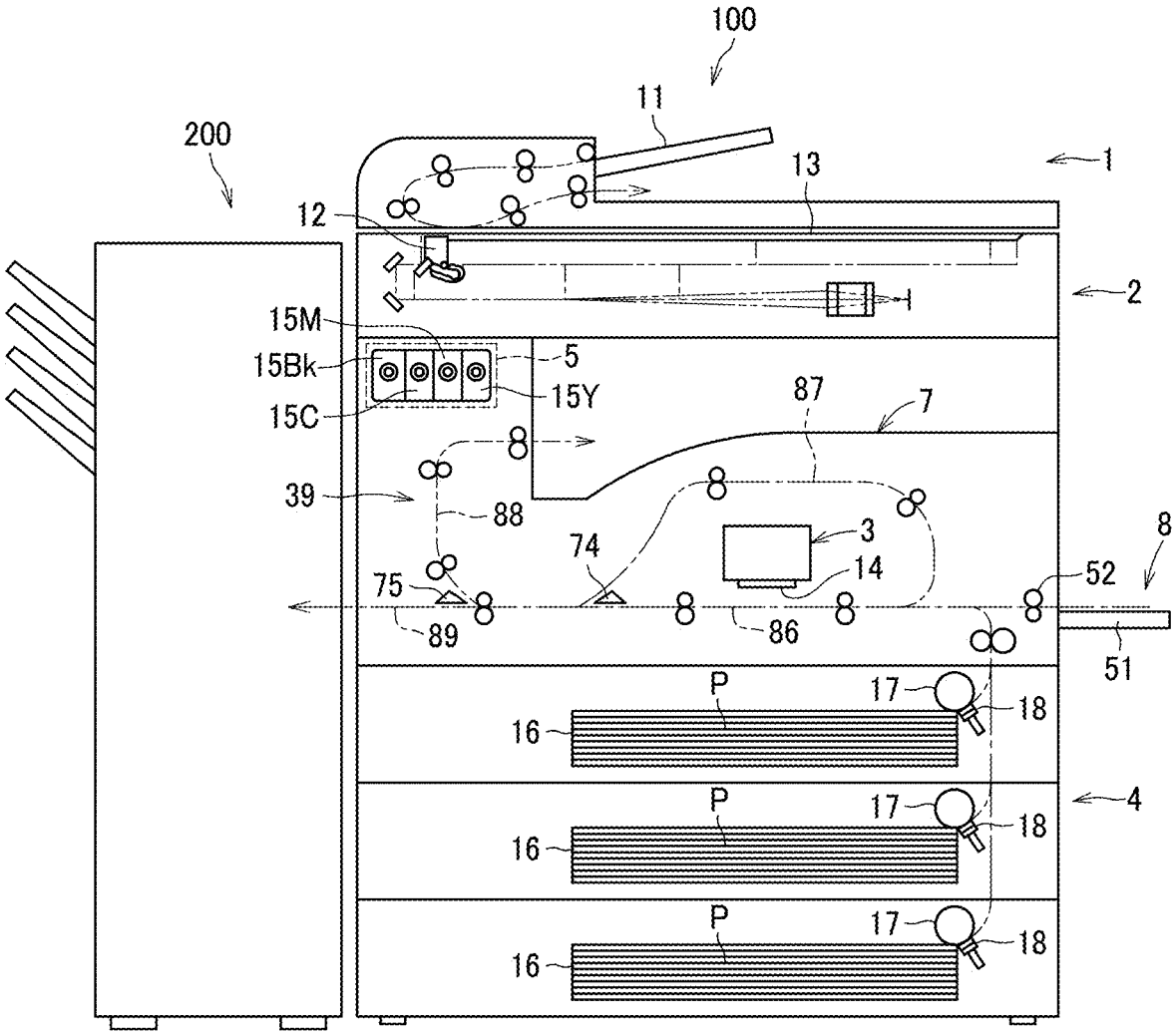
FIG. 21 is a diagram illustrating still another example of an image forming apparatus including a conveying device according to an embodiment of the present disclosure.

Further, the conveying device according to an embodiment of the present disclosure can be applied not only to the image forming apparatus having the configuration as illustrated in FIG. 1 but also, for example, to an image forming apparatus having the configuration as illustrated in FIG. 20 or FIG. 21.

Next, a description is given of the configuration of an image forming apparatus 100 according to embodiments of the present disclosure, with reference to FIGS. 20 and 21. Note that the following description is mainly given of the configuration of the image forming apparatus 100 of each of FIGS. 20 and 21 different from the configuration of the image forming apparatus 100 according to the above-described embodiments. In other words, the description of the configuration of the image forming apparatus 100 of each of FIGS. 20 and 21 that is same as or similar to the configuration of the image forming apparatus 100 according to the above-described embodiments may be omitted.

Similar to the image forming apparatus 100 according to the above-described embodiments, the image forming apparatus 100 illustrated in FIG. 20 includes an original document conveying device 1, an image reading device 2, an image forming device 3, a sheet feeding device 4, a cartridge container 5, a conveying device 39, and upper and lower sheet ejection portions 7. Different from the image forming apparatus 100 according to the above-described embodiments, the image forming apparatus 100 illustrated in FIG. 20 further includes a bypass sheet feeding device 8. Different from the image forming device 3 in FIG. 1, the image forming device 3 in FIG. 20 is disposed facing a sheet conveyance passage 80 in which the sheet P is conveyed in a direction obliquely to the horizontal direction.

The bypass sheet feeding device 8 includes a bypass tray 51 and a bypass sheet feed roller 52. The bypass tray 51 functions as a sheet loader to load a sheet(s) P. The bypass sheet feed roller 52 serves as a sheet feeder to feed the sheet P from the bypass tray 51. The bypass tray 51 is attached to the housing of the image forming apparatus 100 and is openable and closable with respect to the housing of the image forming apparatus 100. In other words, the bypass tray 51 is rotatably attached to the housing of the image forming apparatus 100. When the bypass tray 51 is open (in the state illustrated in FIG. 20), a sheet P or a bundle of sheets P are loaded on the bypass tray 51 to feed the sheet P to the housing of the image forming apparatus 100.

In the image forming apparatus 100 illustrated in FIG. 20, as a print job start instruction is issued, the sheet P is supplied from the sheet feeding device 4 or from the bypass sheet feeding device 8 and is conveyed to the image forming device 3 by the conveying device 39. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 71 guides the sheet P to a sheet reverse passage 81. Then, as the sheet P passes the sheet reverse passage 81, the sheet P is reversed from the front face to the back face, and then is conveyed to the image forming device 3 again to form an image on the back face of the sheet P.

The sheet P having an image formed on one side or both sides is conveyed further downstream by the conveying device 39 through the first passage changer 71. A second passage changer 72 guides the sheet P selectively to a sheet conveyance passage 82 that runs toward the upper sheet ejection portion 7 or to a sheet conveyance passage 83 that runs toward the lower sheet ejection portion 7. In a case in which the sheet P is guided to the sheet conveyance passage 82 toward the upper sheet ejection portion 7, the sheet P is ejected to the upper sheet ejection portion 7. On the other hand, when the sheet P is guided to the sheet conveyance passage 83 toward the lower sheet ejection portion 7, a third passage changer 73 guides the sheet P selectively to a sheet conveyance passage 84 toward the lower sheet ejection portion 7 or to a sheet conveyance passage 85 toward the sheet alignment apparatus 200.

Then, when the sheet P is guided to the sheet conveyance passage 84 toward the lower sheet ejection portion 7, the sheet P is ejected to the lower sheet ejection portion 7. On the other hand, when the sheet P is guided to the sheet conveyance passage 85 toward the sheet alignment apparatus 200, the sheet is conveyed to the sheet alignment apparatus 200, so that the bundle of sheets P is aligned and stacked.

Similar to the image forming apparatus 100 illustrated in FIG. 20, the image forming apparatus 100 illustrated in FIG. 21 includes an original document conveying device 1, an image reading device 2, an image forming device 3, a sheet feeding device 4, a cartridge container 5, a conveying device 39, a sheet ejection portion 7, and a bypass sheet feeding device 8. Note that, in this case, similar to the image forming device 3 in FIG. 1, the image forming device 3 in FIG. 21 is disposed facing a sheet conveyance passage 80 in which the sheet P is conveyed in the horizontal direction.

In the image forming apparatus 100 illustrated in FIG. 21, as a print job start instruction is issued, the sheet P is supplied from the sheet feeding device 4 or from the bypass sheet feeding device 8 and is conveyed to the image forming device 3 by the conveying device 39. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 74 guides the sheet P to a sheet reverse passage 87. Then, as the sheet P passes the sheet reverse passage 87, the sheet P is reversed from the front face to the back face and is conveyed to the image forming device 3 again, so that an image is formed on the back face of the sheet P.

The sheet P having an image formed on one side or both sides is conveyed further downstream by the conveying device 39 through the first passage changer 74. A second passage changer 75 guides the sheet P selectively to a sheet conveyance passage 88 that runs toward the sheet ejection portion 7 or to a sheet conveyance passage 89 that runs toward the sheet alignment apparatus 200. When the sheet P is guided to the sheet conveyance passage 88 toward the sheet ejection portion 7, the sheet P is ejected to the sheet ejection portion 7. On the other hand, when the sheet P is guided to the sheet conveyance passage 89 toward the sheet alignment apparatus 200, the sheet P is conveyed to the sheet alignment apparatus 200, so that the bundle of sheets P is aligned and stacked.

Also in the image forming apparatus configured as described above as illustrated in FIGS. 20 and 21, it is desirable to apply the above-described configuration to the conveyance passage along which the sheet P is conveyed from the image forming device 3 to the sheet ejection portion 7, as in the image forming apparatus illustrated in FIG. 1. In other words, even in such a conveyance passage, ink may be disturbed or the contact trace of the spur wheels 42 may be formed by the contact of the spur wheels 42 with the liquid applied face of the sheet P. Therefore, the contact pressure of the spur wheels 42 with respect to the sheet P is desirably set to be smaller on the upstream side than on the downstream side. However, if the contact pressure of the spur wheels 42 with respect to the sheet P is smaller on the upstream side than on the downstream side, the conveying performance on the upstream side may decrease as described above. Hence, in the conveyance passage, the interval between the conveyance units is set to be smaller on the upstream side than on the downstream side or the number of spur wheels is set to be larger on the upstream side than on the downstream side. Alternatively, both of the configurations may be adopted. Thus, the conveying performance on the upstream side can be enhanced.

Figure 22:
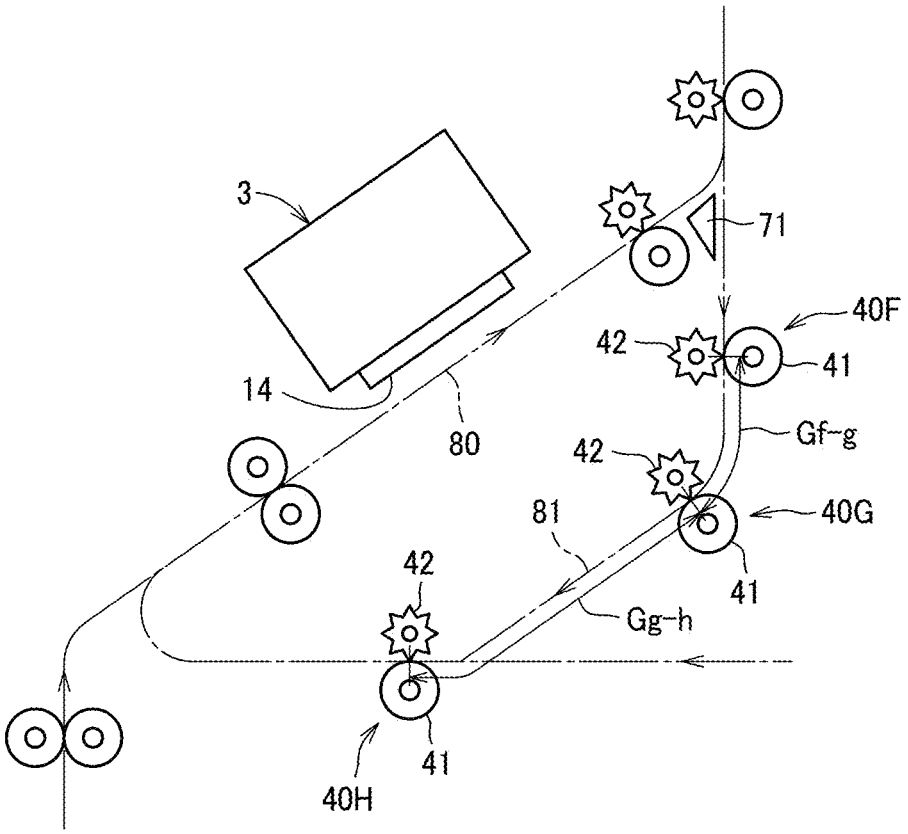
FIG. 22 is a diagram illustrating a configuration of a sheet reverse passage according to an embodiment of the present disclosure.

Further, the configuration according to an embodiment of the present disclosure is not limited to the conveyance passage for conveying the sheet P to the sheet ejection portion 7, and may be applied to a sheet reverse passage for reversing the front and back of the sheet P and conveying the sheet P to the image forming device 3. FIG. 22 depicts the configuration of a sheet reverse passage 81 according to an embodiment of the present disclosure.

For the sheet reverse passage 81 illustrated in FIG. 22, the rear end side of the sheet P immediately after image formation is turned by the switchback operation (conveyance in the opposite direction) of the sheet P to enter the sheet reverse passage 81 as the leading end side. If the spur wheels 42 strongly contact the front end side of the sheet P ink might be disturbed or contact traces of the spur wheels 42 might be formed. Hence, in the sheet reverse passage 81, it is desirable that the contact pressure between the rollers 41 and the spur wheels 42 decreases in order from the most downstream conveyance unit 40H to the upstream conveyance units 40G and 40F. When the rollers 41 and the spur wheels 42 are shifted in the axial direction so as not to contact each other, the entry amount R (see FIG. 16) of the spur wheels 42 may be decreased in order from the most downstream conveyance unit 40H to the upstream conveyance units 40G and 40F. Such a configuration can restrain disturbance of ink and generation of contact traces due to contact of the spur wheels 42 with the sheet P.

However, when the contact pressure and the entry amount are set as described above, the conveying performance on the upstream side is deteriorated. Hence, the intervals Gf-g and Gg-h between the conveyance units disposed in the sheet reverse passage 81 are set to be smaller on the upstream side than on the downstream side (Gg-h>Gf-g). Such a configuration can enhance the conveying performance on the upstream side as in the above-described embodiments. In addition, the number of the spur wheels 42 may increase in order from the most downstream conveyance unit 40H to the upstream conveyance units 40G and 40F. Alternatively, both of the above-described configurations may be adopted.

In addition, the configuration according to an embodiment of the present disclosure is not limited to a case in which the configuration is applied to a conveyance passage in which the conveyance direction of a sheet changes, for example, a case in which a sheet is conveyed from the horizontal direction to the vertically upward direction. For example, the configuration according to an embodiment of the present disclosure can also be applied to a conveyance passage that conveys a sheet only in the horizontal direction.

Further, the configuration according to an embodiment of the present disclosure may be applied to not only an image forming apparatus but also a liquid discharge apparatus that discharges liquid that does not form an image. In other words, the liquid discharge apparatus according to an embodiment of the present disclosure may be, for example, an inkjet image forming apparatus that discharges ink to form an image on the sheet or a treatment liquid discharge apparatus that discharges treatment liquid on the surface of the sheet for the purpose of modifying the surface of the sheet.

Figure 23:
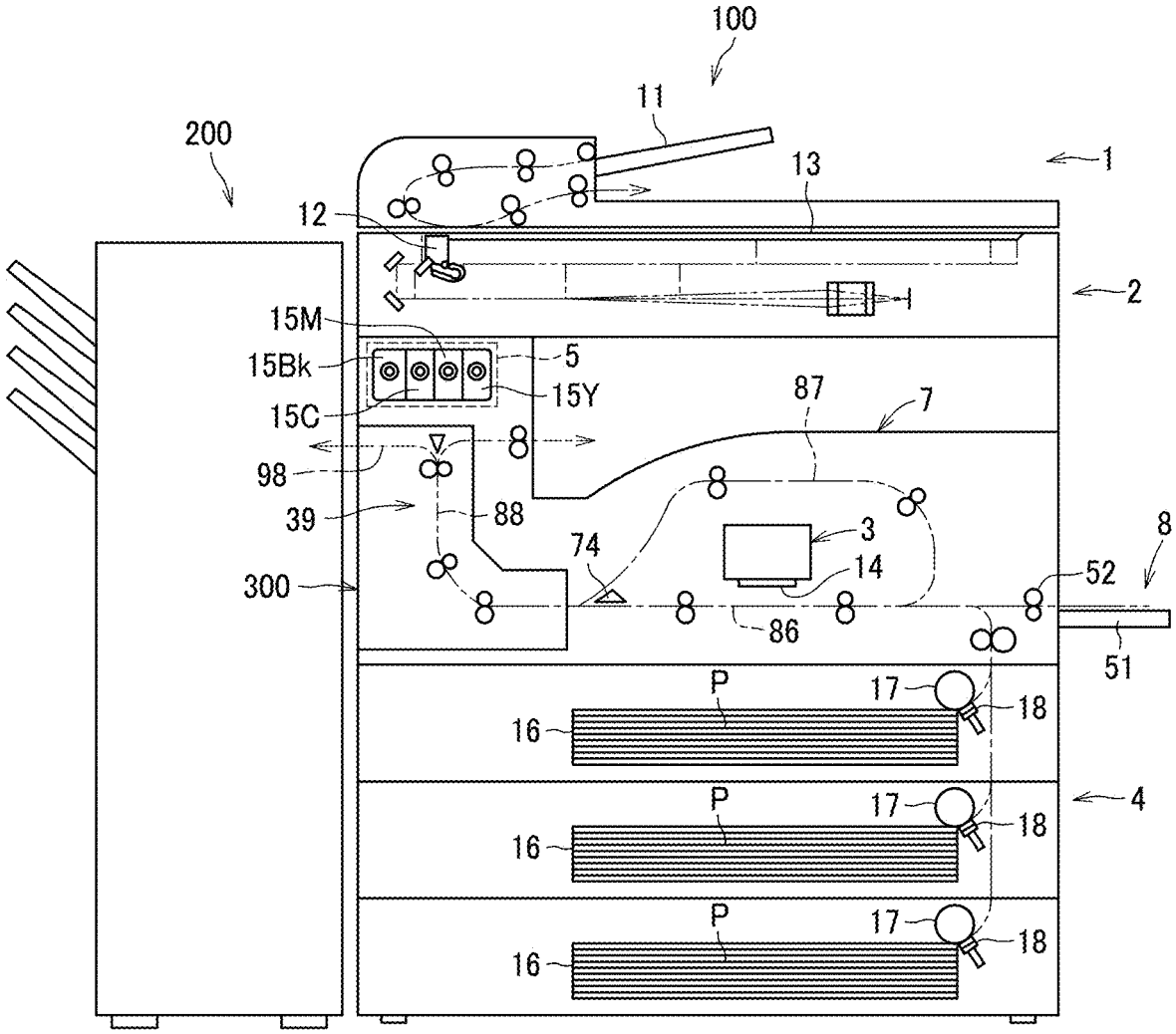
FIG. 23 is a diagram illustrating a configuration of a detachable unit according to an embodiment of the present disclosure.

The configuration according to an embodiment of the present disclosure can also be applied to a unit that can be attached to and detached from a body of an image forming apparatus. A conveying device 39 illustrated in FIG. 23 is mounted on a unit 300 that is attachable to and detachable from a body of an image forming apparatus 100. The conveying device 39 includes a sheet conveyance passage 88 and a conveyance passage 98 that convey a sheet on which an image is formed to a post-processing device (for example, a sheet alignment apparatus 200). In the sheet conveyance passage 88 and the conveyance passage 98 included in the conveying device 39, the contact pressure, the arrangement, the number, and the like of the rollers and the spur wheels as the conveyance units are also set to be the same as those of the conveyance passage 90 (see FIG. 2) described above. Thus, the conveying performance can be enhanced.

Figure 24:
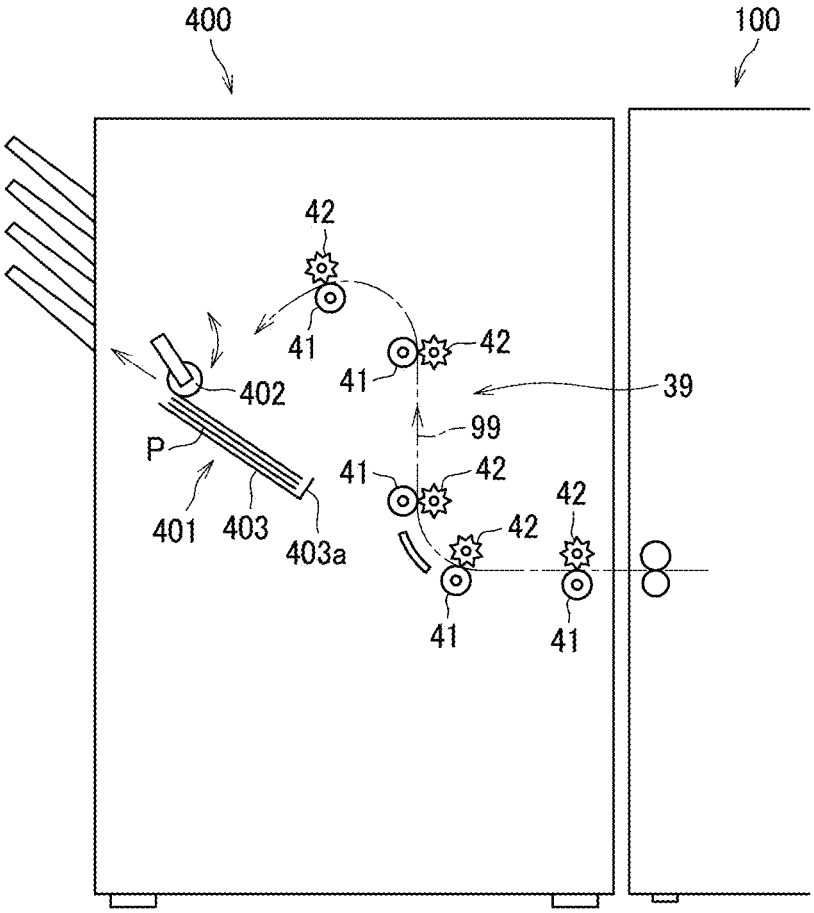
FIG. 24 is a diagram illustrating a configuration of a post-processing apparatus according to an embodiment of the present disclosure.

A conveying device according to an embodiment of the present disclosure is applicable to a post-processing apparatus 400 as illustrated in FIG. 24. The post-processing apparatus 400 includes a conveying device 39 that conveys a sheet and a post-processing device 401 that performs post-processing such as stapling and punching to the sheet.

As the sheet is conveyed from the image forming apparatus 100 to the post-processing apparatus 400 illustrated in FIG. 24, the sheet is conveyed by the conveying device 39 and is loaded on a sheet stacking tray 403 of the post-processing device 401. At this time, in a case in which the sheet is stacked in the sheet stacking tray 403 with the face up (with the image forming surface facing up), the order of image formation may be set to be reversed, in other words, the image may be formed from the last page first. Further, the sheet P stacked on the sheet stacking tray 403 is conveyed by the sheet conveyance roller 402 provided in the post-processing device 401 in the reverse direction with the trailing end to the leading end. By so doing, the trailing end of the sheet P contacts a trailing end regulator 403*a* of the sheet stacking tray 403, so that the position of the trailing end of the sheet P is aligned. Further, in order not to hinder ejection of the sheet to the sheet stacking tray 403, the sheet conveyance roller 402 is disposed to be movable from a position at which the sheet conveyance roller 402 contacts the sheet P to a retreat position at which the sheet conveyance roller 402 does not contact the sheet P. In the state in which the position of the trailing end of the sheet P is aligned, the stapling process and the punching process are performed to the sheet P. Thereafter, the sheet conveyance roller 402 rotates in the reverse direction, and therefore the sheet P on the sheet stacking tray 403 is ejected to the outside of the post-processing apparatus 400. In the conveyance passage 99 of the conveying device 39 mounted on the post-processing apparatus 400, the contact pressure, the arrangement, the number, and the like of the rollers 41 and the spur wheels 42 as the conveyance units are set to be similar to those of the conveyance passage 90 (see FIG. 2) described above. Thus, the conveying performance can be enhanced.

Further, the sheet to be conveyed by a conveying device according to an embodiment of the present disclosure may be, for example, a cut sheet that is previously cut in the predetermined size in the sheet conveyance direction or a sheet roll that is a longitudinal-length sheet wound in a roll shape. Further, the sheet may be made of resin, metal, cloth, leather, or the like other than paper as long as the sheet has flexibility and can be conveyed while being bent.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The invention claimed is:

1. A conveying device, comprising:

a plurality of rotating bodies spaced apart in a sheet conveyance direction in which a sheet is conveyed; and a plurality of projecting rotators spaced apart in the sheet conveyance direction on a side of an opposite face opposite a liquid applied face of the sheet, each of the plurality of projecting rotators having a plurality of projections projecting radially outward, wherein the plurality of rotating bodies are arranged to contact the plurality of projecting rotators, wherein a contact pressure of the plurality of rotating bodies with the plurality of projecting rotators is smaller on an upstream side in the sheet conveyance direction than a contact pressure of the plurality of rotating bodies with the plurality of projecting rotators on a downstream side in the sheet conveyance direction, and wherein one of an interval between the plurality of rotating bodies in the sheet conveyance direction and an interval between the plurality of projecting rotators in the sheet conveyance direction is smaller on the upstream side in the sheet conveyance direction than the one of an interval between the plurality of rotating bodies in the sheet conveyance direction and an interval between the plurality of projecting rotators in the sheet conveyance direction on the downstream side in the sheet conveyance direction.

2. The conveying device according to claim 1, further comprising:

another plurality of rotating bodies and another plurality of projecting rotators that are shifted in an axial direction relative to each other and do not contact each other.

3. The conveying device according to claim 1, wherein the one of an interval between the plurality of rotating bodies in the sheet conveyance direction and an interval between the plurality of projecting rotators in the sheet conveyance direction decreases toward the upstream side in the sheet conveyance direction.

4. The conveying device according to claim 1, wherein positions of the plurality of projecting rotators are different in the sheet width direction between the upstream side in the sheet conveyance direction and the downstream side in the sheet conveyance direction.

5. The conveying device according to claim 1, wherein the plurality of rotating bodies and the plurality of projecting rotators are disposed in each of an applied-region passing range that a liquid applied region on the sheet passes and a non-applied-region passing range that is a sheet passing range other than the applied-region passing range.

6. The conveying device according to claim 5, wherein the plurality of rotating bodies and the plurality of projecting rotators disposed in each of the applied-region passing range and the non-applied-region passing range contact each other, and a contact pressure between the plurality of rotating bodies and the plurality of projecting rotators disposed in the non-applied-region passing range is greater than a contact pressure between the plurality of rotating bodies and the plurality of projecting rotators disposed in the applied-region passing range.

7. The conveying device according to claim 5, wherein the plurality of rotating bodies and the plurality of projecting rotators disposed in each of the applied-region passing range and the non-applied-region passing range are shifted in an axial direction and do not contact each other, wherein an entry amount of the plurality of projecting rotators disposed in the non-applied-region passing range that enters in an inner diameter direction of the plurality of rotating bodies beyond an outer peripheral surface of the plurality of rotating bodies is greater than an entry amount of the plurality of projecting rotators disposed in the applied-region passing range that enters in the inner diameter direction of the plurality of rotating bodies beyond the outer peripheral surface of the plurality of rotating bodies.

8. A liquid discharge apparatus comprising:
the conveying device according to claim 1; and
a liquid discharger configured to discharge liquid onto the sheet.

9. An image forming apparatus comprising:
the conveying device according to claim 1; and
an image forming device configured to discharge liquid onto the sheet to form an image onto the sheet.

10. A post-processing apparatus comprising:
the conveying device according to claim 1; and
a post-processing device configured to perform processing on the sheet.

11. The conveying device according to claim 1, further comprising a conveyance passage configured to convey the sheet to a post-processing device configured to perform processing on the sheet.

12. A conveying device, comprising:
a plurality of rotating bodies spaced apart in a sheet conveyance direction in which a sheet is conveyed; and
a plurality of projecting rotators spaced apart in the sheet conveyance direction on a side of an opposite face opposite a liquid applied face of the sheet, each of the plurality of projecting rotators having a plurality of projections projecting radially outward,
wherein the plurality of rotating bodies are arranged to contact the plurality of projecting rotators,
wherein a contact pressure of the plurality of rotating bodies with the plurality of projecting rotators is smaller on an upstream side in the sheet conveyance direction than a contact pressure of the plurality of rotating bodies with the plurality of projecting rotators on a downstream side in the sheet conveyance direction, and
wherein a number of the plurality of projecting rotators arranged in a sheet width direction is larger on the upstream side in the sheet conveyance direction than a number of the plurality of projecting rotators arranged in a sheet width direction on the downstream side in the sheet conveyance direction.

13. The conveying device according to claim 12,
wherein the number of the plurality of projecting rotators arranged in the sheet width direction increases toward the upstream side in the sheet conveyance direction.

14. An image forming apparatus comprising:
the conveying device according to claim 12; and
an image forming device configured to discharge liquid onto the sheet to form an image onto the sheet.

15. A post-processing apparatus comprising:
the conveying device according to claim 12; and
a post-processing device configured to perform processing on the sheet.

16. A conveying device, comprising:
a plurality of rotating bodies spaced apart in a sheet conveyance direction in which a sheet is conveyed; and
a plurality of projecting rotators spaced apart in the sheet conveyance direction on a side of an opposite face opposite a liquid applied face of the sheet, each of the plurality of projecting rotators having a plurality of projections projecting radially outward,
wherein the plurality of rotating bodies are shifted from the plurality of projecting rotators in an axial direction so that the plurality of rotating bodies does not contact the plurality of projecting rotators,
wherein an entry amount of the plurality of projecting rotators that enters in an inner diameter direction of the plurality of rotating bodies beyond an outer peripheral surface of the plurality of rotating bodies is smaller on an upstream side in the sheet conveyance direction than an entry amount of the plurality of projecting rotators that enters in an inner diameter direction of the plurality of rotating bodies beyond an outer peripheral surface of the plurality of rotating bodies on a downstream side in the sheet conveyance direction, and
wherein one of an interval between the plurality of rotating bodies in the sheet conveyance direction and an interval between the plurality of projecting rotators in the sheet conveyance direction is smaller on the upstream side in the sheet conveyance direction than the one of an interval between the plurality of rotating bodies in the sheet conveyance direction and an interval between the plurality of projecting rotators in the sheet conveyance direction is smaller on the upstream side in the sheet conveyance direction on the downstream side in the sheet conveyance direction.

17. An image forming apparatus comprising:
the conveying device according to claim 16; and
an image forming device configured to discharge liquid onto the sheet to form an image onto the sheet.

18. A post-processing apparatus comprising:
the conveying device according to claim 16; and
a post-processing device configured to perform processing on the sheet.

19. A conveying device, comprising:
a plurality of rotating bodies spaced apart in a sheet conveyance direction in which a sheet is conveyed; and
a plurality of projecting rotators spaced apart in the sheet conveyance direction on a side of an opposite face opposite a liquid applied face of the sheet, each of the plurality of projecting rotators having a plurality of projections projecting radially outward,
wherein the plurality of rotating bodies are shifted from the plurality of projecting rotators in an axial direction so that the plurality of rotating bodies does not contact the plurality of projecting rotators,
wherein an entry amount of the plurality of projecting rotators that enters in an inner diameter direction of the plurality of rotating bodies beyond an outer peripheral surface of the plurality of rotating bodies is smaller on an upstream side in the sheet conveyance direction than an entry amount of the plurality of projecting rotators that enters in an inner diameter direction of the plurality of rotating bodies beyond an outer peripheral surface of the plurality of rotating bodies on a downstream side in the sheet conveyance direction, and
wherein a number of the plurality of projecting rotators arranged in a sheet width direction is larger on the upstream side in the sheet conveyance direction than a number of the plurality of projecting rotators arranged in a sheet width direction on the downstream side in the sheet conveyance direction.

20. An image forming apparatus comprising:
the conveying device according to claim 19; and
an image forming device configured to discharge liquid onto the sheet to form an image onto the sheet.

21. A post-processing apparatus comprising:
the conveying device according to claim 19; and
a post-processing device configured to perform processing on the sheet.

* * * * *